US010267004B2

(12) United States Patent
Smith

(10) Patent No.: US 10,267,004 B2
(45) Date of Patent: Apr. 23, 2019

(54) FLOOD PROTECTION SYSTEM

(71) Applicant: Thomas A. Smith, Carlisle, MA (US)

(72) Inventor: Thomas A. Smith, Carlisle, MA (US)

( * ) Notice: Subject to any disclaimer, the term of this patent is extended or adjusted under 35 U.S.C. 154(b) by 0 days.

(21) Appl. No.: 15/678,495

(22) Filed: Aug. 16, 2017

(65) Prior Publication Data

US 2018/0051433 A1 Feb. 22, 2018

Related U.S. Application Data

(60) Provisional application No. 62/376,055, filed on Aug. 17, 2016.

(51) Int. Cl.

| | |
|---|---|
| ***E02B 3/10*** | (2006.01) |
| ***E02B 7/00*** | (2006.01) |
| ***E02B 7/14*** | (2006.01) |
| ***E02B 3/12*** | (2006.01) |

(52) U.S. Cl.

CPC ..... *E02B 3/108* (2013.01); *E02B 3/127* (2013.01)

(58) Field of Classification Search

CPC ... E02B 3/10; E02B 3/108; E02B 7/00; E02B 7/14; E02D 31/002

USPC ..... 405/107, 110, 111, 115

See application file for complete search history.

(56) References Cited

U.S. PATENT DOCUMENTS 422,901 A * 3/1890 Arnett ..... E02D 17/18 405/114
1,829,864 A * 11/1931 Kidd ..... E02B 7/10 405/111
1,879,836 A * 9/1932 Yale ..... E02B 7/10 405/111
3,561,177 A * 2/1971 Agro ..... E02B 3/126 428/117
3,618,279 A * 11/1971 Kidd ..... E04B 2/46 52/223.7
4,363,563 A * 12/1982 Hallenius ..... B65G 5/00 405/53
4,661,014 A 4/1987 Aubert
(Continued)

FOREIGN PATENT DOCUMENTS

CN 105421292 A 3/2016

OTHER PUBLICATIONS

Written Opinion of the International Searching Authority for International Application No. PCT/US2017/047161 dated Oct. 30, 2017, (five (5) pages).

*Primary Examiner* — Benjamin F Fiorello
*Assistant Examiner* — Edwin J Toledo-Duran
(74) *Attorney, Agent, or Firm* — Iandiorio Teska & Coleman, LLP

(57) ABSTRACT

A flood protection system including a tube plate assembly including a plurality of orifices arranged in a predetermined pattern and density. A tube attachment subsystem is associated with each of the plurality of orifices and is configured to secure an open ended independent barrier tube thereto. A plurality of spaced walls are configured to support the tube plate assembly above the ground such that each barrier tube extends vertically downward from the tube plate to the ground. Filling each barrier tube with the fluid provides outward hydrostatic pressure at each tube-to-tube interface such that friction loss of a flow of flood water along each barrier tube-to-tube interface pathway stops the ingress of the flood water from a flood area to a protected area.

26 Claims, 24 Drawing Sheets

(56) References Cited

U.S. PATENT DOCUMENTS 5,449,246 A * 9/1995 Housley ..... E01C 9/002 404/42
6,428,870 B1 * 8/2002 Bohnhoff ..... E02B 11/00 405/50
6,585,449 B2 * 7/2003 Chen ..... E01C 11/18 404/2
6,739,797 B1 * 5/2004 Schneider ..... B28B 7/0029 404/35
6,918,447 B2 7/2005 Robinson, Jr.
6,962,463 B2 * 11/2005 Chen ..... E01C 7/14 404/72
6,962,464 B1 * 11/2005 Chen ..... E01C 11/226 405/43
7,546,712 B2 * 6/2009 Shaw ..... E04B 2/04 52/223.8
7,591,610 B2 * 9/2009 Krichten ..... E03F 1/005 405/43
8,162,567 B2 * 4/2012 Obermeyer ..... E03F 1/002 405/43
8,267,618 B2 * 9/2012 Chen ..... E01C 3/003 404/17
8,382,398 B2 * 2/2013 Stauffacher ..... E02B 3/108 405/111
8,496,396 B1 * 7/2013 Allen ..... E01O 5/08 404/36
8,956,077 B2 2/2015 Abeles
9,004,815 B2 4/2015 Taylor
9,085,864 B2 7/2015 Ortiz
9,303,365 B2 * 4/2016 Gooden ..... A01G 13/0237
D795,383 S * 8/2017 Kent ..... D23/202
9,938,697 B1 * 4/2018 Chen ..... E03B 3/28
2001/0002968 A1 * 6/2001 Black ..... E02D 29/0208 405/36
2004/0047688 A1 3/2004 Clement
2006/0099033 A1 5/2006 Boraggina
2007/0154265 A1 7/2007 Stauffacher et al.
2007/0243021 A1 10/2007 Tyler

* cited by examiner

Tubes = n, D = d
Path Length = 5 1/2 "units"
Turns = 6

Tubes = 4n, D = 1/2 d
Path Length = 5 3/4 "units"
Turns = 14

FLOOD PROTECTION SYSTEM

RELATED APPLICATIONS

This application claims benefit of and priority to U.S. Provisional Application Ser. No. 62/376,055 filed Aug. 17, 2016, under 35 U.S.C. §§ 119, 120, 363, 365, and 37 C.F.R. § 1.55 and § 1.78, which is incorporated herein by this reference.

FIELD OF THE INVENTION

This invention relates to a flood protection system.

BACKGROUND OF THE INVENTION

One conventional system used for flood protection utilizes sand bags typically stacked in a trapezoidal dam shape to accommodate greater hydrostatic forces at greater depths of water. When built, the width of the base of the dam is typically much larger than the width at the top. Additionally, the height of such a conventional flood barrier is typically built to be at least 25% to 33% greater than the depth of the flood water.

The U.S. Army Corps of Engineers estimates that a dam or wall of sand bags 4 feet high by 100 feet in length with a trapezoidal shape would require about 7800 sand bags. At a cost of about $0.39 per bag and about $2200 for sand, the total material cost would be about $5242. Additionally, it would take about 180 man hours (just for one person) to fill and stack 7800 sand bags. This cost does not include labor for a second person needed to hold the sand bags open. More sophisticated conventional approaches using sand may be less time and labor intensive, but are typically more expensive and are not readily available.

Even when built, walls of sand bags are prone to leaking because there are gaps between each bag, the bag itself is permeable to water, and tiny gaps between grains of sand provide a pathway for floodwater to penetrate the barrier. Moreover, when sand bags are utilized, the sand bags themselves can be contaminated by flood water and must be disposed of after the flood water subsides. This is also labor intensive and expensive.

Another conventional flood protection system utilizes hydro bags which are impermeable bags filled with water. In operation, the hydro bags are laid out in the desired area to be protected from a flood and then filled with water. However, hydro bags are very expensive, typically costing about $20 for a 4 inch by 6 foot bag, $30 for a 6 inch by 6 foot bag, $85 for a 12 foot by 6 inch bag, and $500 for a 20 inch by 20 foot bag. Additionally, the larger bags, even when empty, are very heavy, cumbersome, and very difficult to place. Thus, the operation could not be performed by elderly or less physically fit persons. Hydro bags also suffer from the problem of having gaps between adjacent bags when stacked.

One conventional apparatus for flood control is disclosed in U.S. Publ. 2007/0243021, incorporated by reference herein. As disclosed therein, vertically placed bladders are disposed around an area to be protected. However, similar as discussed above with relation to the hydro bags, such a system is expensive and is prone to leaking because of the gaps between adjacent bags.

SUMMARY OF THE INVENTION

In one aspect, a flood protection system is featured. The system includes tube plate assembly including a tube plate including a plurality of orifices arranged in a predetermined pattern and density. A tube attachment subsystem is associated with each of the plurality of orifices and is configured to secure an open ended independent barrier tube thereto. A plurality of spaced walls are configured to support the tube plate assembly above the ground such that each barrier tube extends vertically downward from the tube plate to the ground. Filling each barrier tube with the fluid provides outward hydrostatic pressure at each tube-to-tube interface such that friction loss of a flow of flood water along each barrier tube-to-tube interface pathway stops the ingress of the flood water from a flood area to a protected area.

In one embodiment, the predetermined pattern and said density of said plurality of orifices each having a barrier tube attached thereto may be configured to increase the tube-to-tube interface pathway to increase the friction loss to stop the ingress of the flood water from the flood area to the protected area. The predetermined pattern and density of said plurality of orifices each having a barrier tube attached thereto increase a path length and number of turns of the tube-to-tube interface pathway to increase the friction loss of the flow of flood water along each barrier tube-to-tube interface pathway to stop the ingress of the flood water from the flood area to the protected area. The predetermined pattern may include a plurality of orifices arranged in an offset pattern of rows. The predetermined pattern may include a plurality of orifices aligned in rows. The density of the orifices may include a high density of orifices. The density of orifices may include a low density of orifices. The tube plate may include a boss secured to each orifice. The tube attachment subsystem may include a friction tube holder associated with each orifice and configured to secure a barrier tube to the orifice thereto by friction. The friction tube holder may have a cylindrical funnel shape configured to mate with an orifice of the tube plate. The friction tube holder may be configured to mate with a boss coupled to an orifice. The friction tube holder may include a flange attached thereto. The flange may be configured to mate with an orifice of the tube plate. Each said barrier tube may be configured to extend higher than a level of the flood water to create an extended elevation head on each said barrier tube filled with a fluid to increase the outward hydrostatic pressure at each tube-to-tube interface to increase friction loss at each barrier tube-to-tube interface pathway. The system may include a plenum coupled above and to the tube plate assembly configured to store fluid therein to create a super elevation head on each said barrier tube filled with a fluid to increase the outward hydrostatic pressure and increase friction loss at each barrier tube-to-tube interface pathway. The plenum may include a plenum lid sealed to the plenum. A super elevation head connector may be coupled to the plenum. A super elevation head extender may be coupled to the super elevation head connector configured to store fluid therein, the fluid configured to further increase said super elevation head. The system may further include a compression super elevation head subsystem coupled to the super elevation head connector configured to increase hydrostatic pressure in the plenum to create the super elevation head. The compression super elevation head subsystem may include a mechanical pump. The compression super elevation head subsystem may include a hydraulic or pneumatic pump configured to drive a fluid against a piston in a fluid-filled super elevation head connector 184 or gas into the super elevation head connector to create the super elevation head. The system may further include a brace coupled to one of the spaced walls configured to provide support to the tube plate assembly in the spaced walls. The tube plate assembly, the tube plate, the tube attachment subsystem, each barrier tube, and the plurality of spaced walls are positioned below a ground level and deployed in the event of a flood. Each barrier tube may be filled with a fluid having a specific gravity greater than the specific gravity of the flood water to further increase the hydrostatic pressure and increase friction loss.

In another aspect, a flood protection system is featured. The system includes a tube plate assembly including a tube plate including a plurality of orifices arranged in a predetermined pattern and density. A tube attachment subsystem is associated with each of the plurality of orifices is configured to secure an open ended independent barrier tube thereto. A plurality of spaced walls is configured to support the tube plate assembly above the ground such that each barrier tube extends vertically downward from the tube plate to the ground. Filling each said barrier tube with the fluid provides outward hydrostatic pressure at each tube-to-tube interface such that friction loss of a flow of flood water along each barrier tube-to-tube interface pathway stops the ingress of the flood water from a flood area to a protected area. A plenum is coupled above and to the tube plate assembly and is configured to store fluid therein to create a super elevation head on each barrier tube filled with a fluid to increase outward hydrostatic pressure and increase friction loss at each barrier tube-to-tube interface.

In another aspect, a flood protection system is featured. The system includes a tube plate assembly including a tube plate including a plurality of orifices arranged in a predetermined pattern and density. A tube attachment subsystem is associated with each of the plurality of orifices and is configured to secure an open ended independent barrier tube thereto. A plurality of spaced walls is configured to support the tube plate assembly above the ground such that each barrier tube extends vertically downward from the tube plate to the ground. Filling each said barrier tube with the fluid provides outward hydrostatic pressure at each tube-to-tube interface such that friction loss of a flow of flood water along each barrier tube-to-tube interface pathway stops the ingress of the flood water from a flood area to a protected area. Each said barrier tube is configured to extend higher than a level of the flood water to create an extended elevation head on each said barrier tube filled with a fluid to increase the outward hydrostatic pressure at each tube-to-tube interface to increase friction loss at each barrier tube-to-tube interface pathway.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
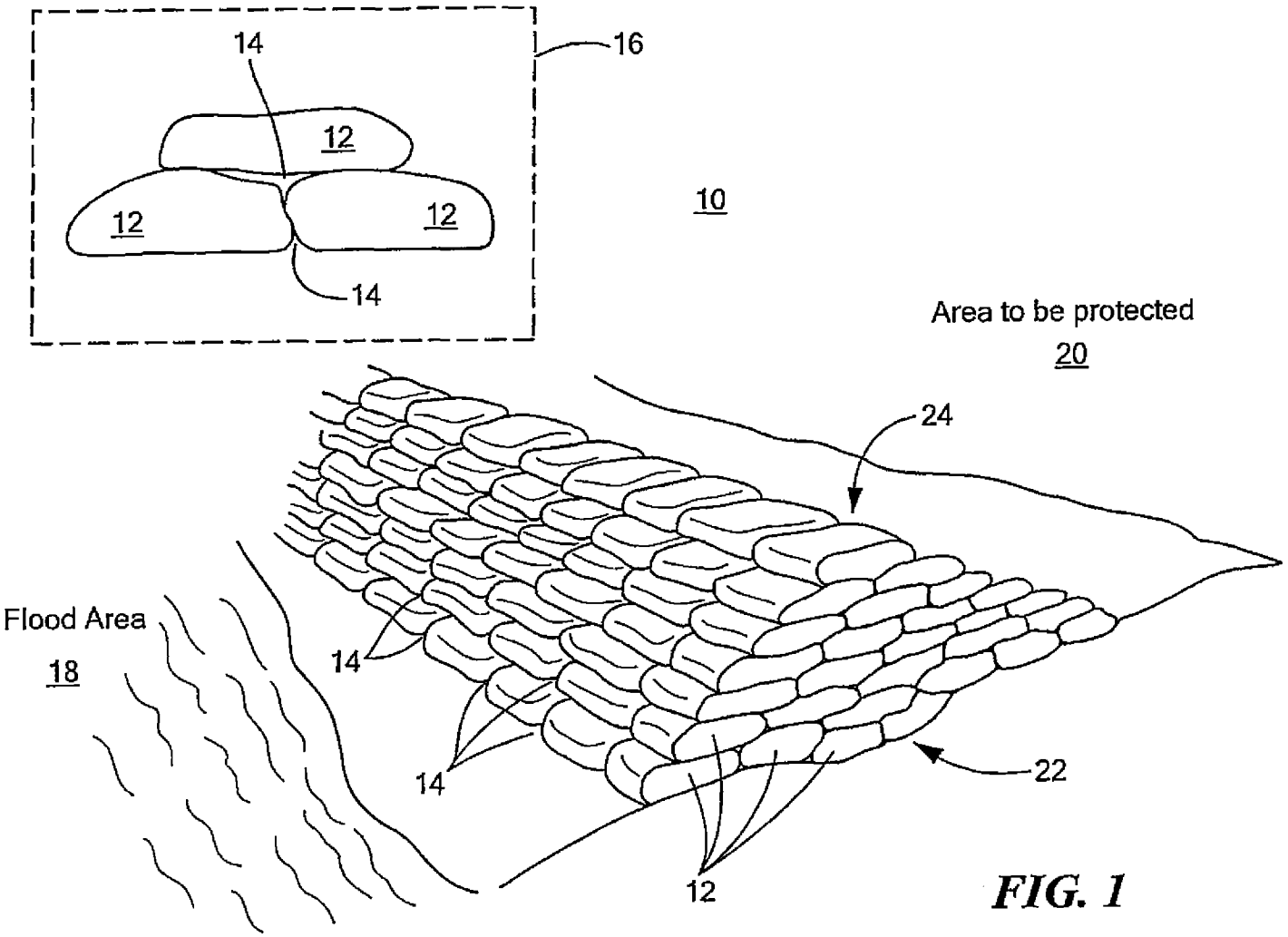
FIG. 1 is a schematic diagram showing one example of a conventional flood protection system which utilizes a plurality of sand bags stacked in a trapezoidal shape.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

As discussed in the Background section above, one conventional system 10, FIG. 1, for flood protection includes utilizing a plurality of sand bags 12 typically stacked in a trapezoidal shape as shown. Due to the shape of the sand bags 12, there are numerous gaps 14 between adjacent bags 12, as shown in further detail in caption 16, in flood area 18 which can allow the flow of flood water into area 20 to be protected. Additionally, the stack of sand bags 12 is typically very wide, e.g., at least several feet wide at base 22 and the dam of sand bags 12 typically needs to be at least 25% to 33% greater than the depth of flood water.

Figure 2:
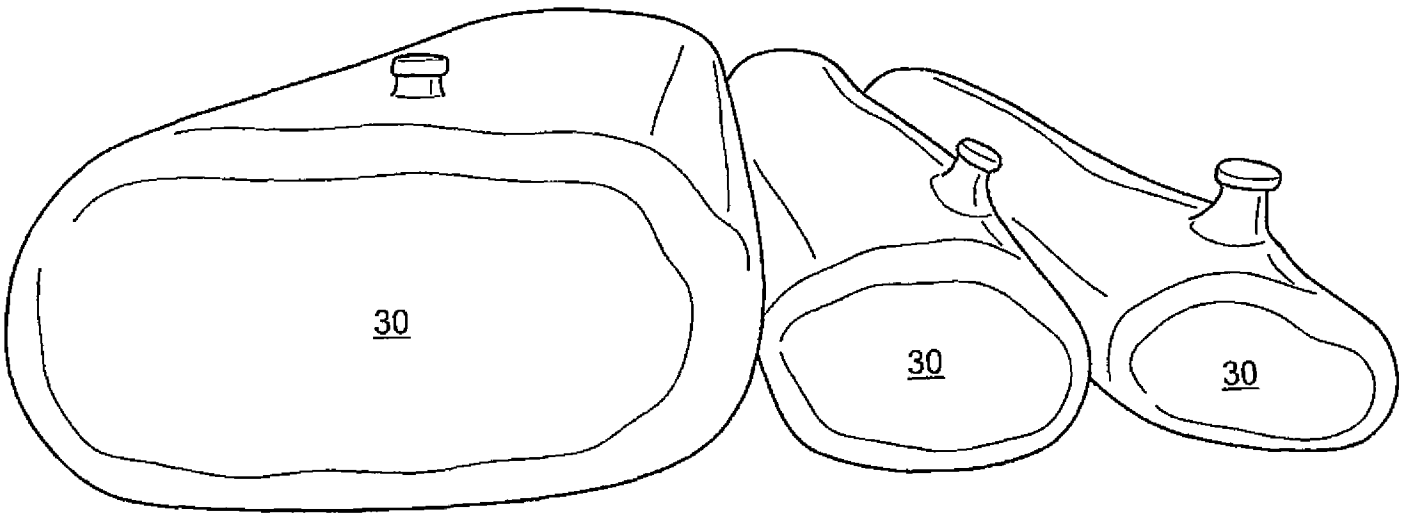
FIG. 2 is a schematic diagram showing an example of conventional hydro bags used for flood protection.
Figure 3:
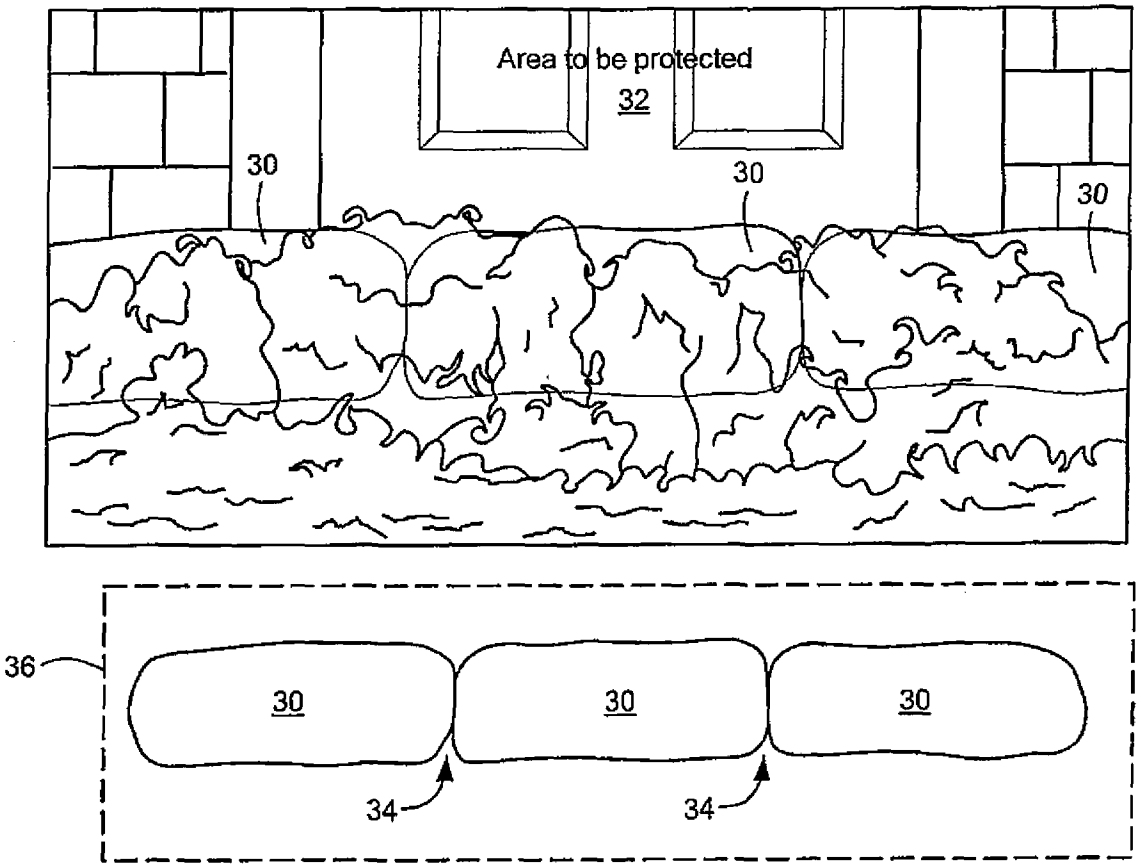
FIG. 3 is a schematic diagram showing an example of the hydro bags shown in FIG. 2 located in front of an area to be protected.

FIG. 2 shows one example of conventional hydro bags 30 which may be used for flood protection. Hydro bags 30 typically have a height of between about 4 inches and 12 inches when filled with a fluid. In operation, hydro bags 30 are typically laid out around or in front of an area to be protected from water, then filled with water as shown. FIG. 3 shows an example of hydro bags 30 located in front of area to be protected 32. As discussed in the Background section, hydro bags are very expensive and cumbersome to use. Additionally, when stacked, hydro bags 30 also include gaps, e.g., shown at 34 in caption 36, in between adjacent bags, similar to gaps 14, FIG. 1, which leaks the flood water into area 32 to be protected.

Figure 4:
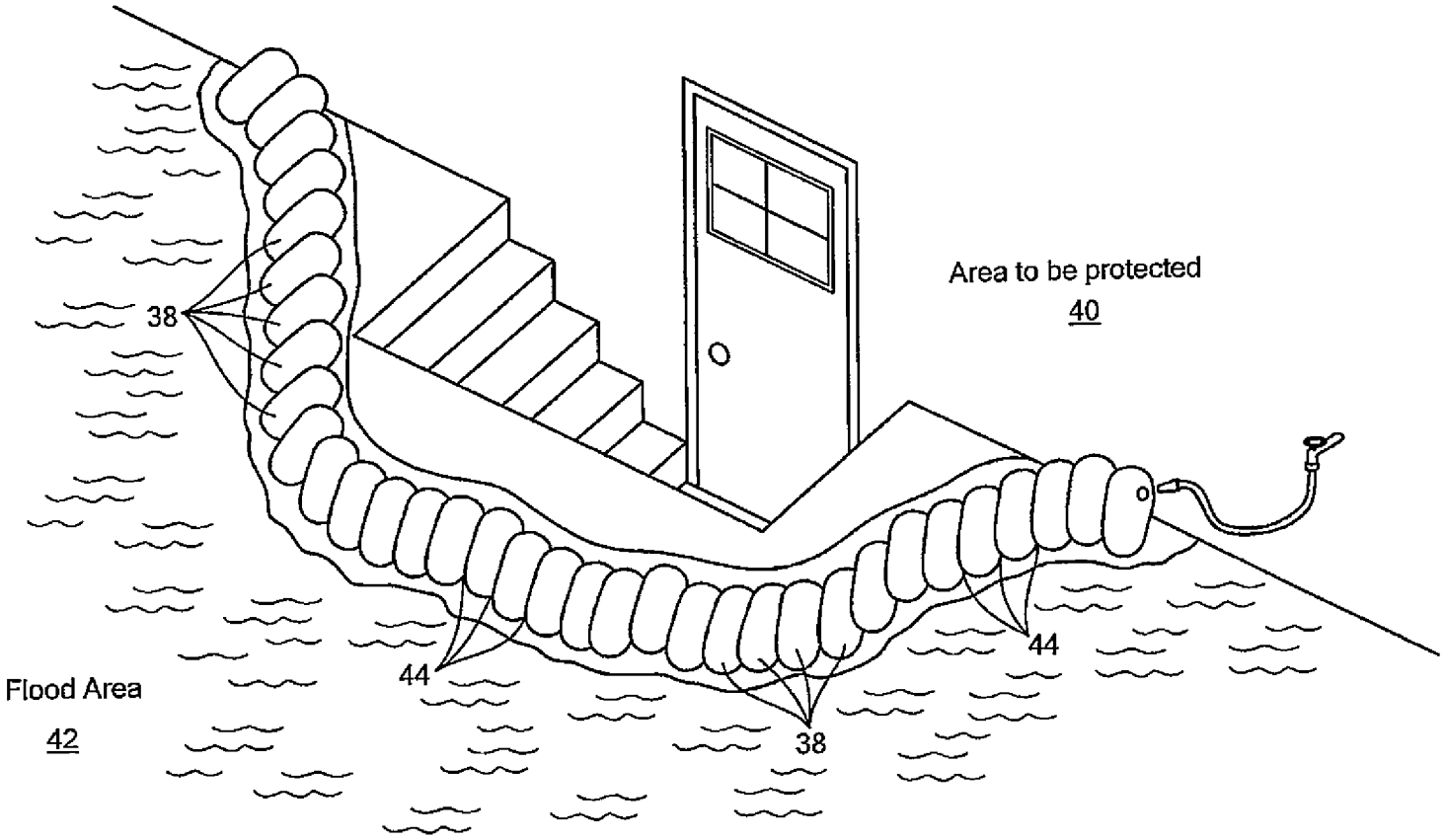
FIG. 4 is a schematic diagram of another conventional flood protection system using a plurality of hydro bags to surround an area to be protected from a flood.

The '021 patent application discussed in the Background section above discloses a plurality of hydro bags 38, FIG. 4, placed to surround area 40 to be protected from flood area 42 as shown. Similar to the stack of sand bags shown in FIG. 1, and hydro bags 30 shown in FIG. 2, there typically are numerous gaps, e.g., indicated at 44, FIG. 4, between adjacent hydro bags 34 where the flood water in flood area 38 can ingress into protected area 36.

In the conventional system discussed above, the small gaps provide a pathway through the barrier into the area to be protected, herein referred to as a protected area (PA). In the sand bag example discussed above, the ratio of barrier width (dimension perpendicular to the interface between the flood and PA) to height of flood for most solutions is usually greater than 1:1. The Federal Emergency Management Agency (FEMA) recommends a 4 foot wide sand bag barrier for a 3 foot flood, i.e., a ratio of 1.33:1. The reason for this recommendation is not just stability of the barrier but also the need for a sufficiently long path through the barrier to generate enough friction losses to dissipate the driving force of the flood water which is proportional to the depth of the flood.

Figure 5:
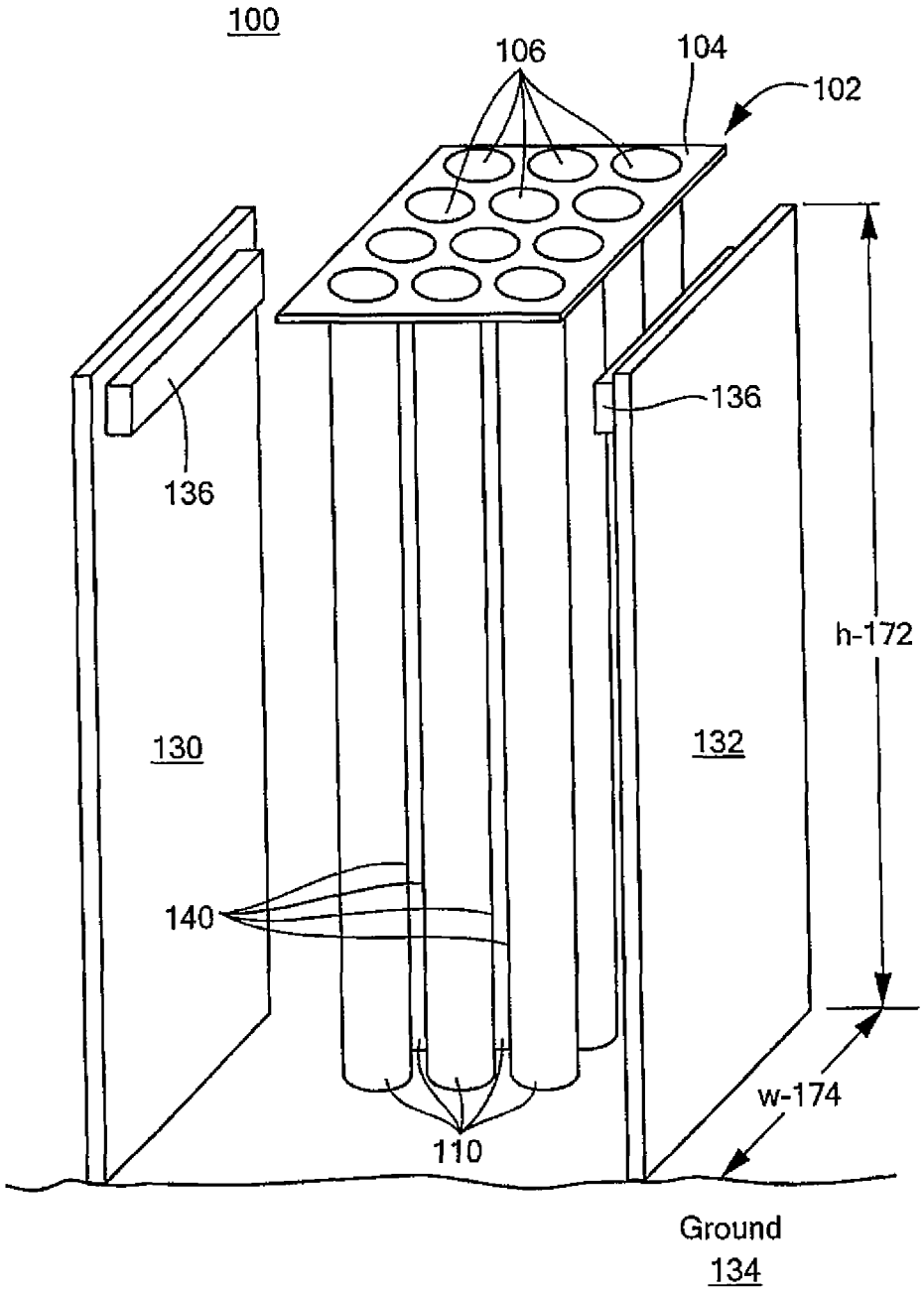
FIGS. 5 and 6 are three-dimensional views showing the primary components of one embodiment of the flood protection system of this invention.
Figure 6:
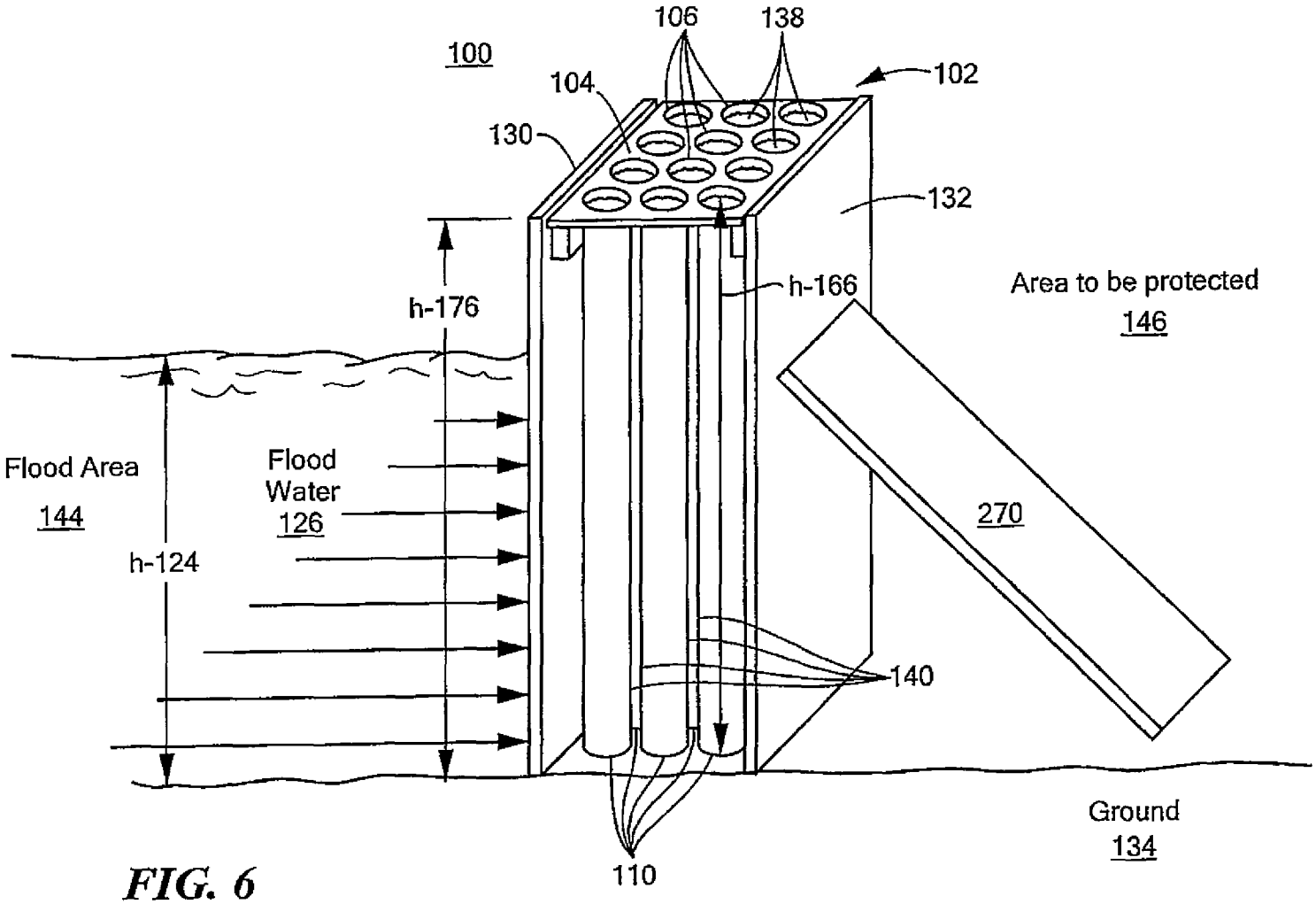
Figure 7:
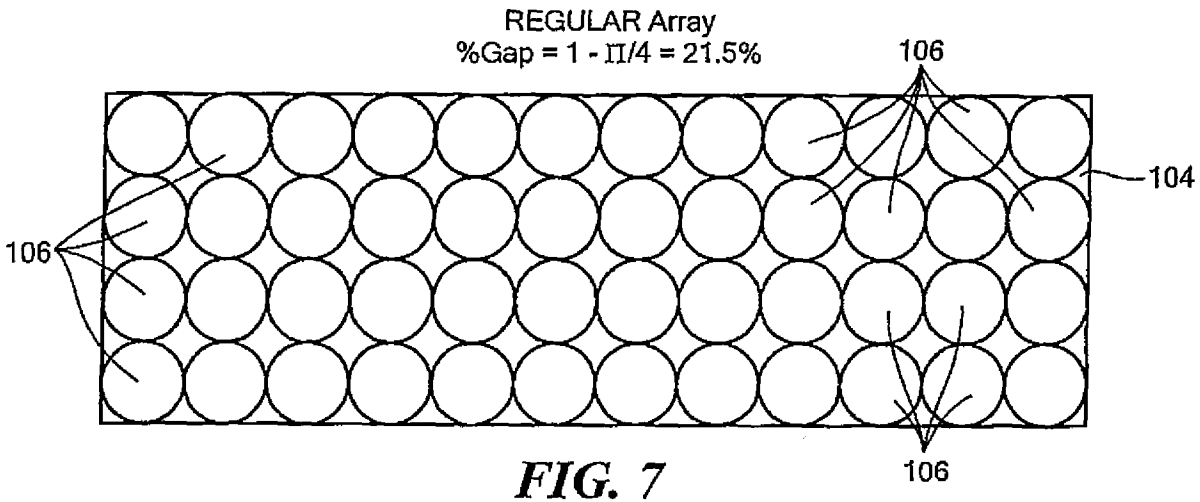
FIGS. 7 and 8 are schematic diagrams show examples of the predetermined pattern and density of orifices in the tube plate shown in FIGS. 5 and 6.
Figure 8:
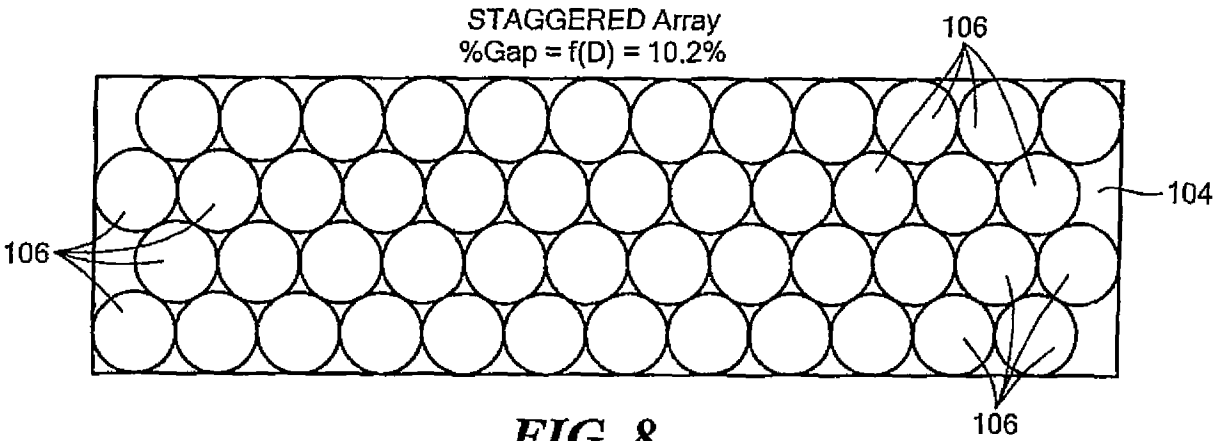
Figure 9:
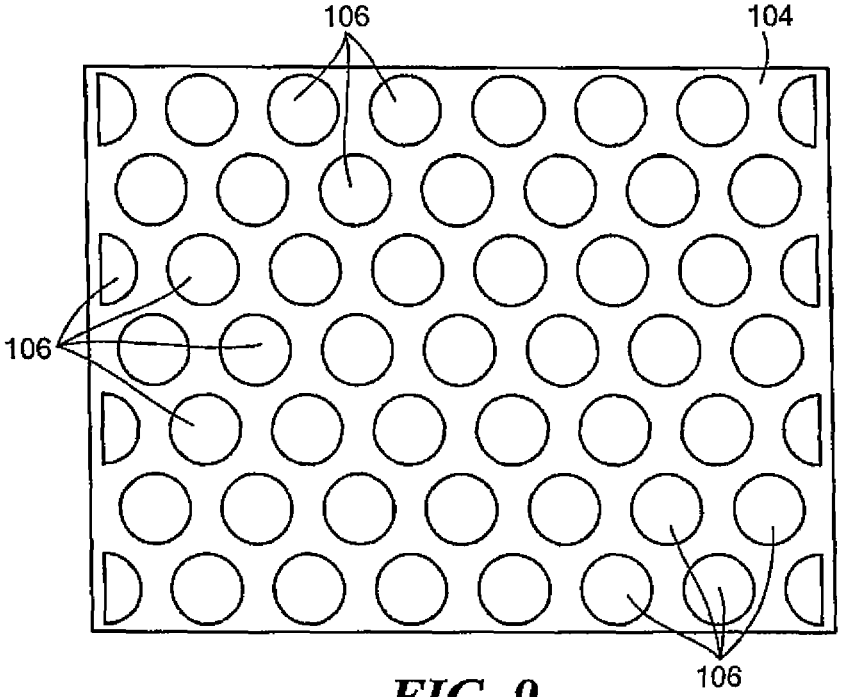
FIG. 9 is a schematic diagram showing in further detail one example of the tube plate assembly shown in FIGS. 5 and 6 having a predetermined pattern and a high density orifices.
Figure 10:
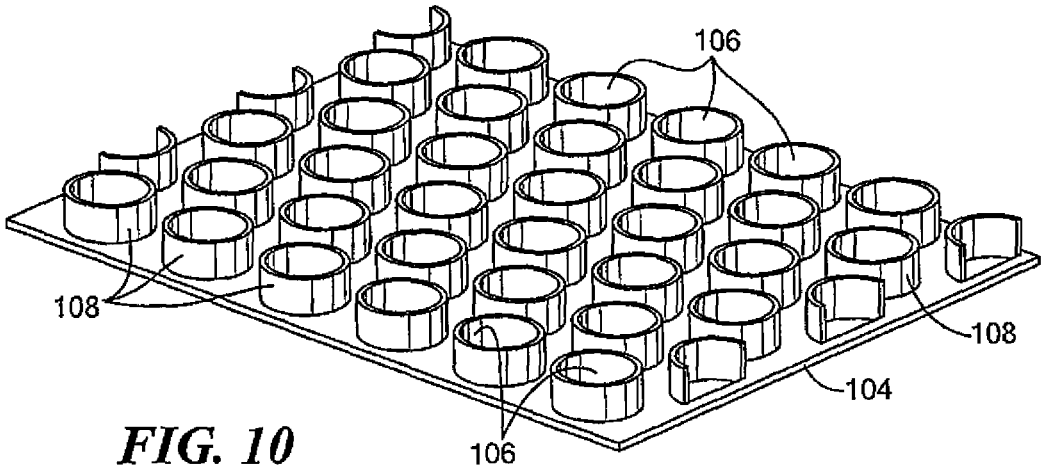
FIG. 10 is a three-dimensional view showing an example of a boss affixed to each of the orifices of the tube plate shown in FIGS. 5 and 6 and also showing an example of a low density of orifices.
Figure 11:
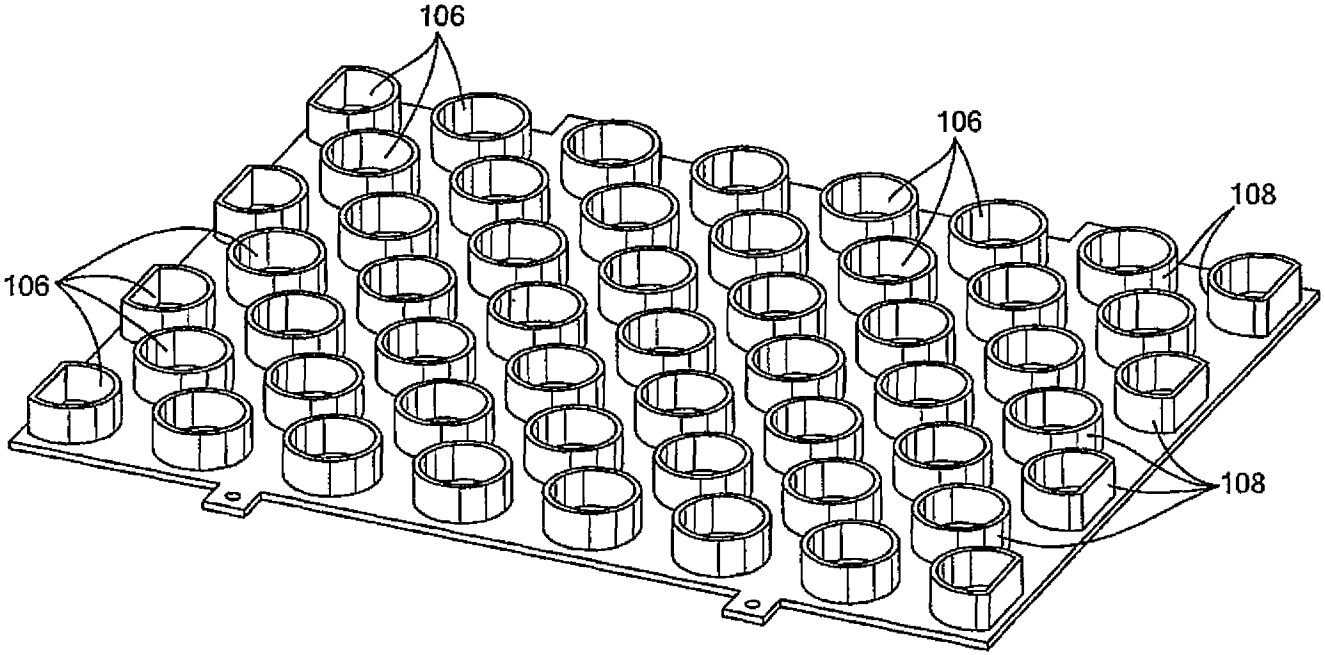
FIG. 11 is a three-dimensional view showing an example of a boss affixed to each of the orifices of the tube plate shown in FIGS. 5 and 6 and also showing an example of a high density of orifices.

There is shown in FIGS. 5 and 6, one embodiment of flood protection system 100 of this invention. FIG. 5 shows the various components of flood protection system 100 before being assembled and FIG. 6 shows flood protection system 100 assembled. Flood protection system 100 preferably includes tube plate assembly 102 which includes tube plate 104 including a plurality of orifices, exemplarily indicated at 106, arranged in a predetermined pattern and density. Tube plate 104 may be made of plastic, aluminum, steel, or similar type rigid material. In one example, the plurality of orifices 106 may be arranged in a pattern of rows, e.g., as shown in FIG. 7, or arranged in a staggered offset pattern as shown, e.g., as shown in FIG. 8. FIG. 9 shows in further detail one example of tube plate 104 having a high density of orifices 106 arranged in a staggered offset pattern. FIG. 10 shows an example of tube plate 104 with a low density of orifices 106 arranged in a staggered offset pattern. In this example, tube plate 106 preferably include boss 108 secured to each orifice 106 as shown. FIG. 11 shows an example of tube plate 104 having a high density of orifices 106 each having boss 108 secured to each orifice 106 and arranged in a staggered offset pattern.

The diameter of each of orifices 106 may range from about ±1 inch to about ±12 inches. In the examples shown in FIGS. 5-11, orifices 106 have a circular shape. In other examples, orifices 106 may have an elliptical shape, a rectangular shape, or any other various practical shapes.

Figure 12:
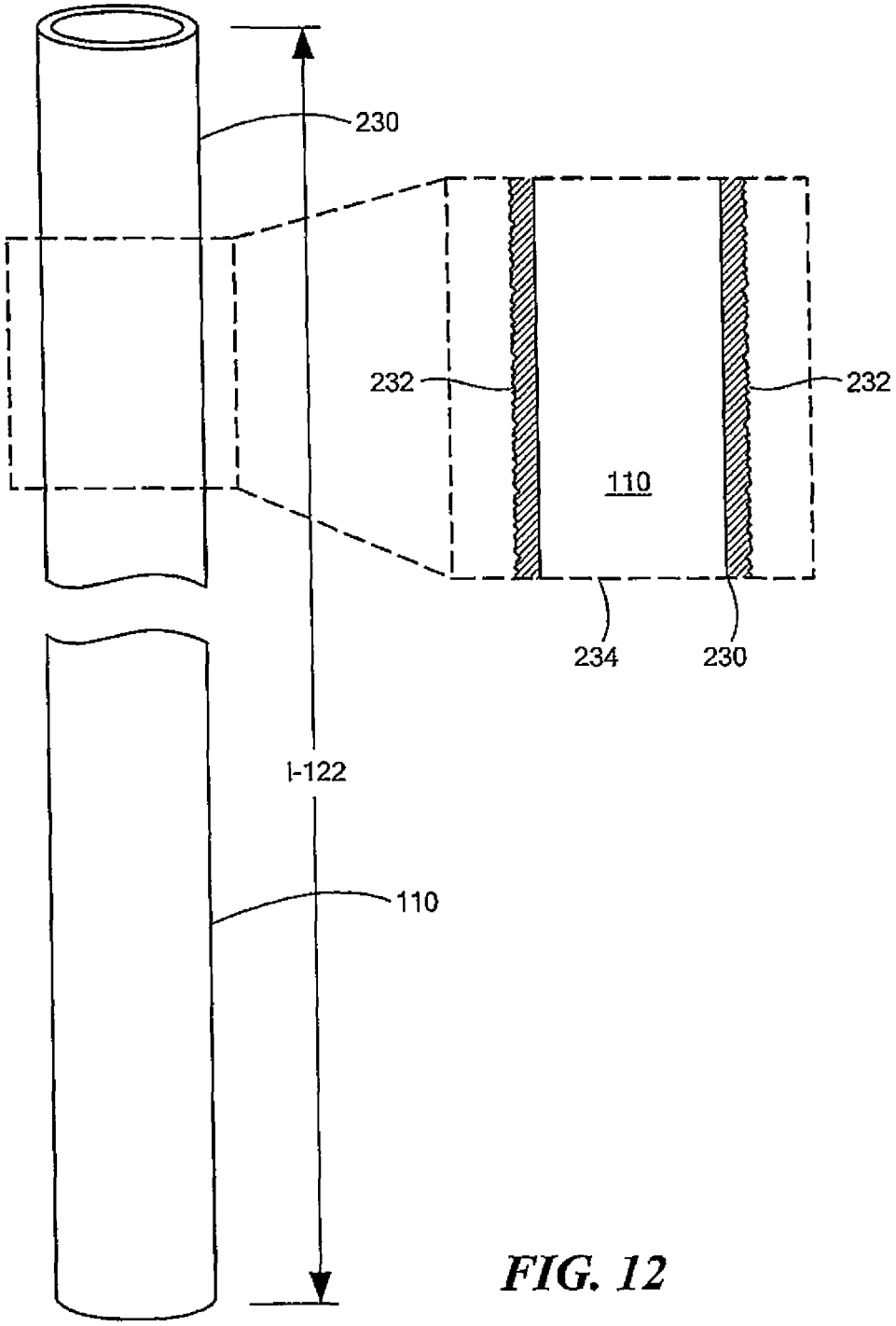
FIG. 12 is a schematic diagram showing in further detail an example of one of the barrier tubes shown in FIGS. 5 and 6.

Flood protection system 100, FIGS. 5 and 6, also includes a tube attachment subsystem associated with each of the plurality of orifices 106 configured to secure an open ended barrier tube, exemplarily indicated at 110, thereto. Each barrier tube 110 is preferably made of a conformable, impermeable material, e.g., plastic, latex, polyisoprene, neoprene, rubber, or similar type material having sufficient plasticity to conform to the shape needed to block the ingress of flood water 126, FIG. 6 from flood area 144 to protected area 146. FIG. 12 shows one example of barrier tube 110, in this example made of neoprene. Each barrier tube 110 may have a circular shape, an elliptical shape, a rectangular shape, or any other various practical shape. Each barrier tube 110 preferably has a length, l-122, which is equal to or preferably greater than height h-176, FIG. 6, of flood water 126, as discussed in further detail below.

Figure 13:
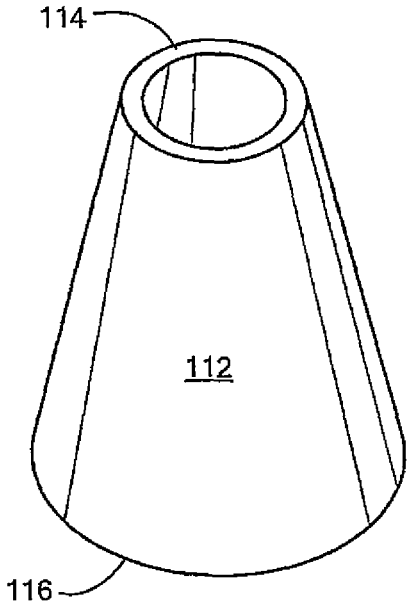
FIG. 13 is a three-dimensional view showing an example of a friction tube holder of the tube attachment subsystem of this invention configured to secure a barrier tube to an orifice of the tube plate shown in one or more of FIGS. 5-12.
Figure 14:
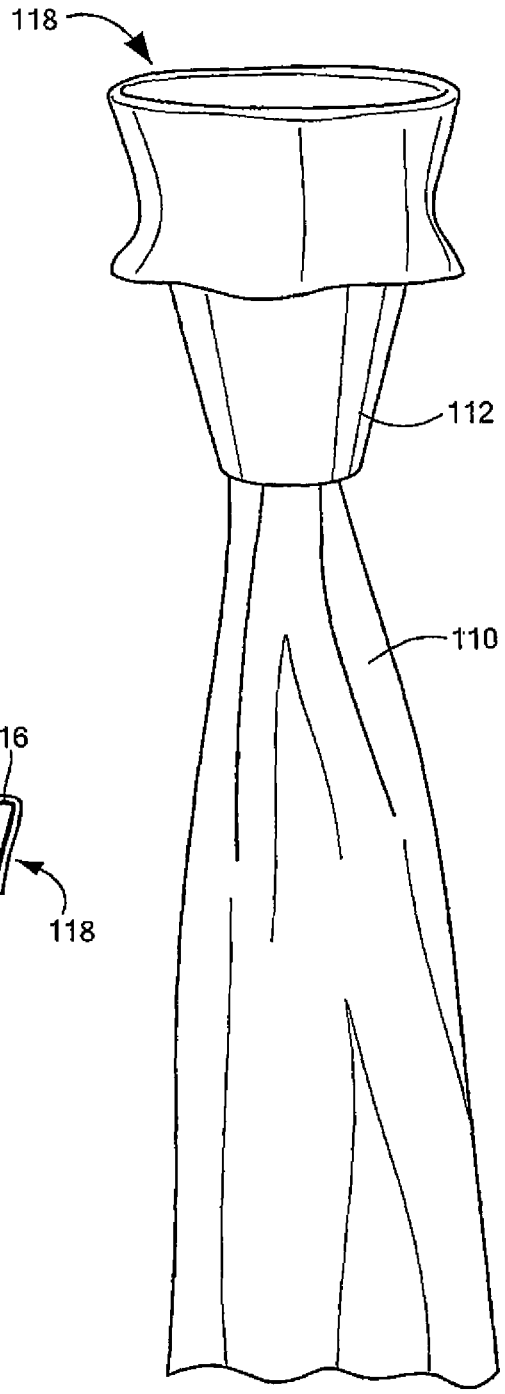
FIG. 14 is a three-dimensional view showing an example of a barrier tube extending through the friction tube holder shown in FIG. 13 used to secure a barrier tube to the friction tube holder by friction.
Figure 15:
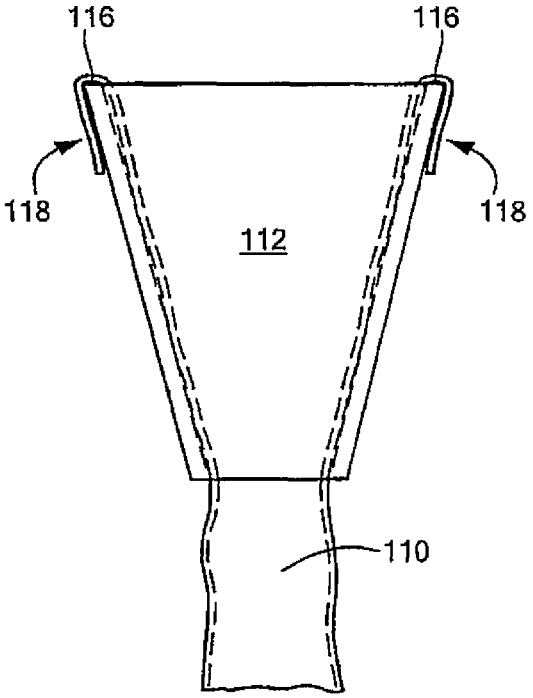
FIG. 15 is a schematic diagram showing in further detail one example of a barrier tube secured to the friction tube holder shown in FIGS. 13-14 by friction.
Figure 16:
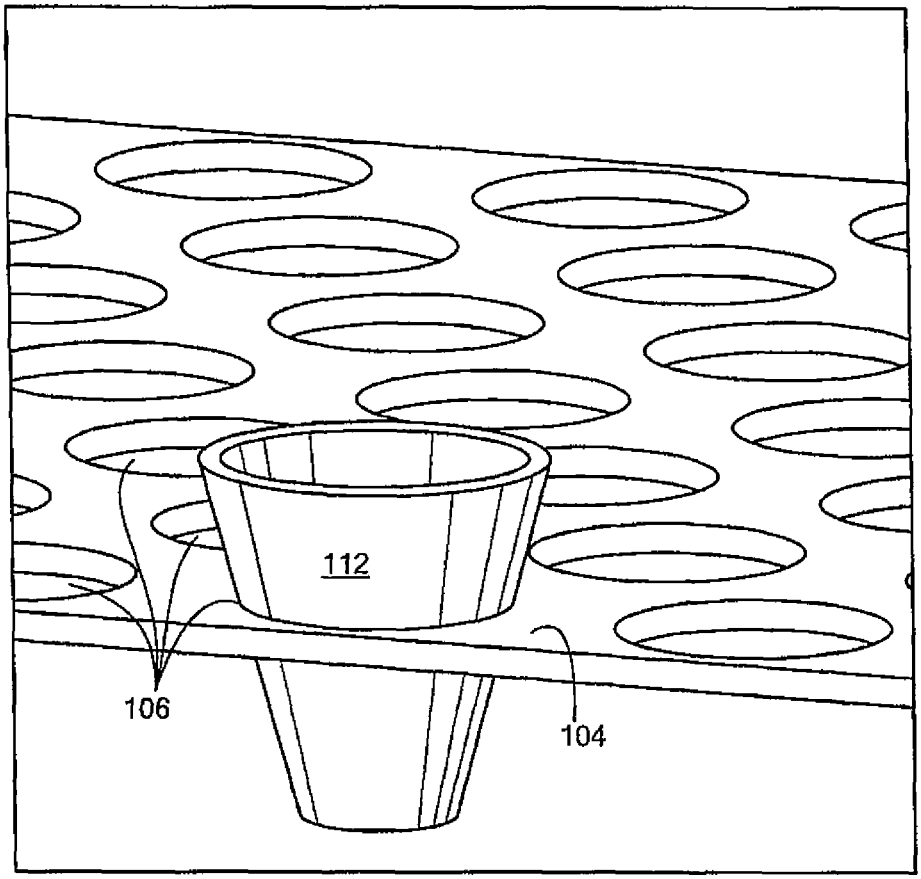
FIG. 16 is a three-dimensional view showing an example of the friction tube holder shown in FIGS. 13-15 in place in an orifice of the tube plate shown in FIGS. 5, 6, and 9.
Figure 17:
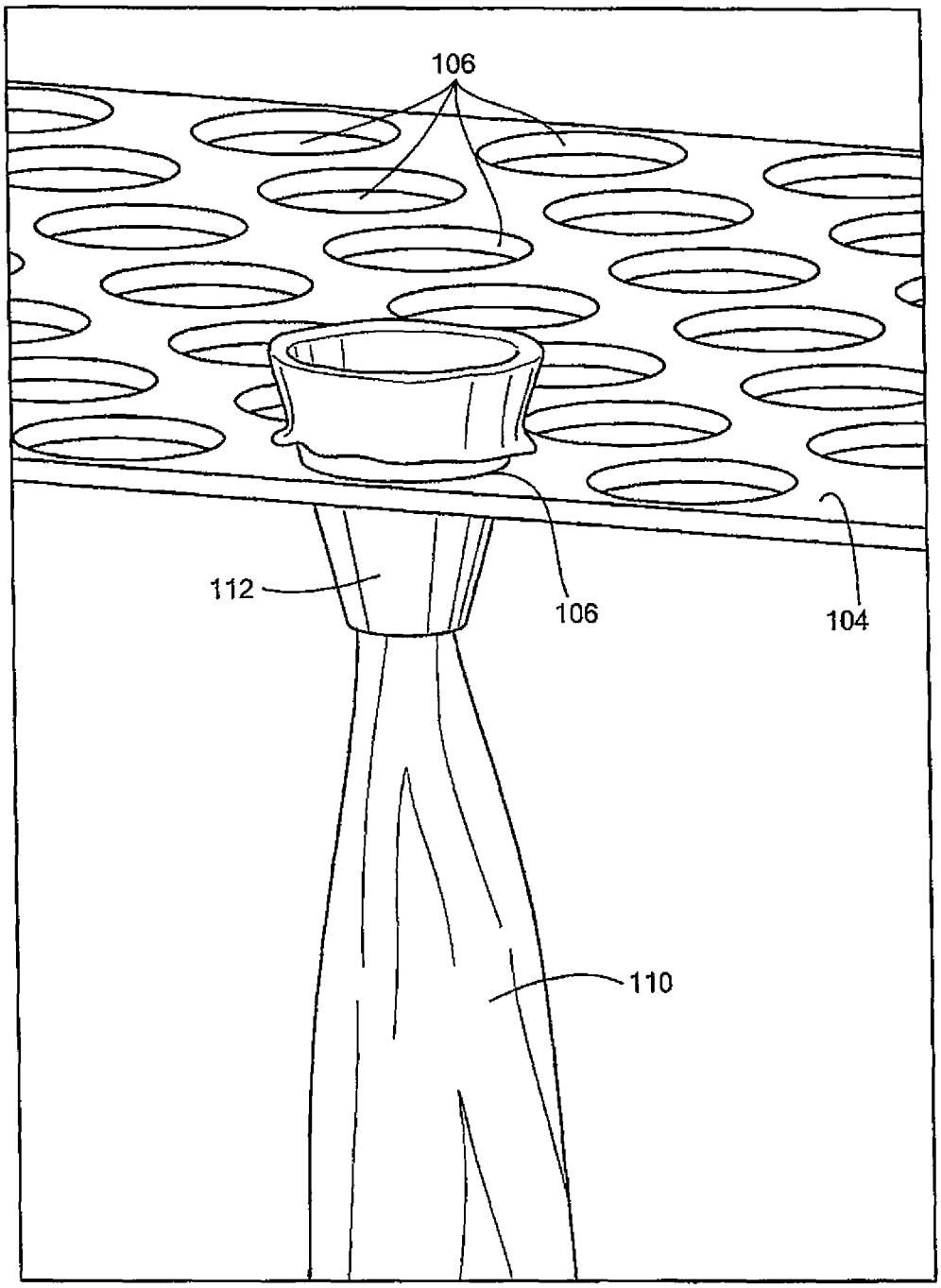
FIG. 17 is a three-dimensional view showing an example of a barrier tube secured to the friction tube holder shown in FIGS. 13-15 in place on the tube plate shown in FIG. 9.
Figure 18:
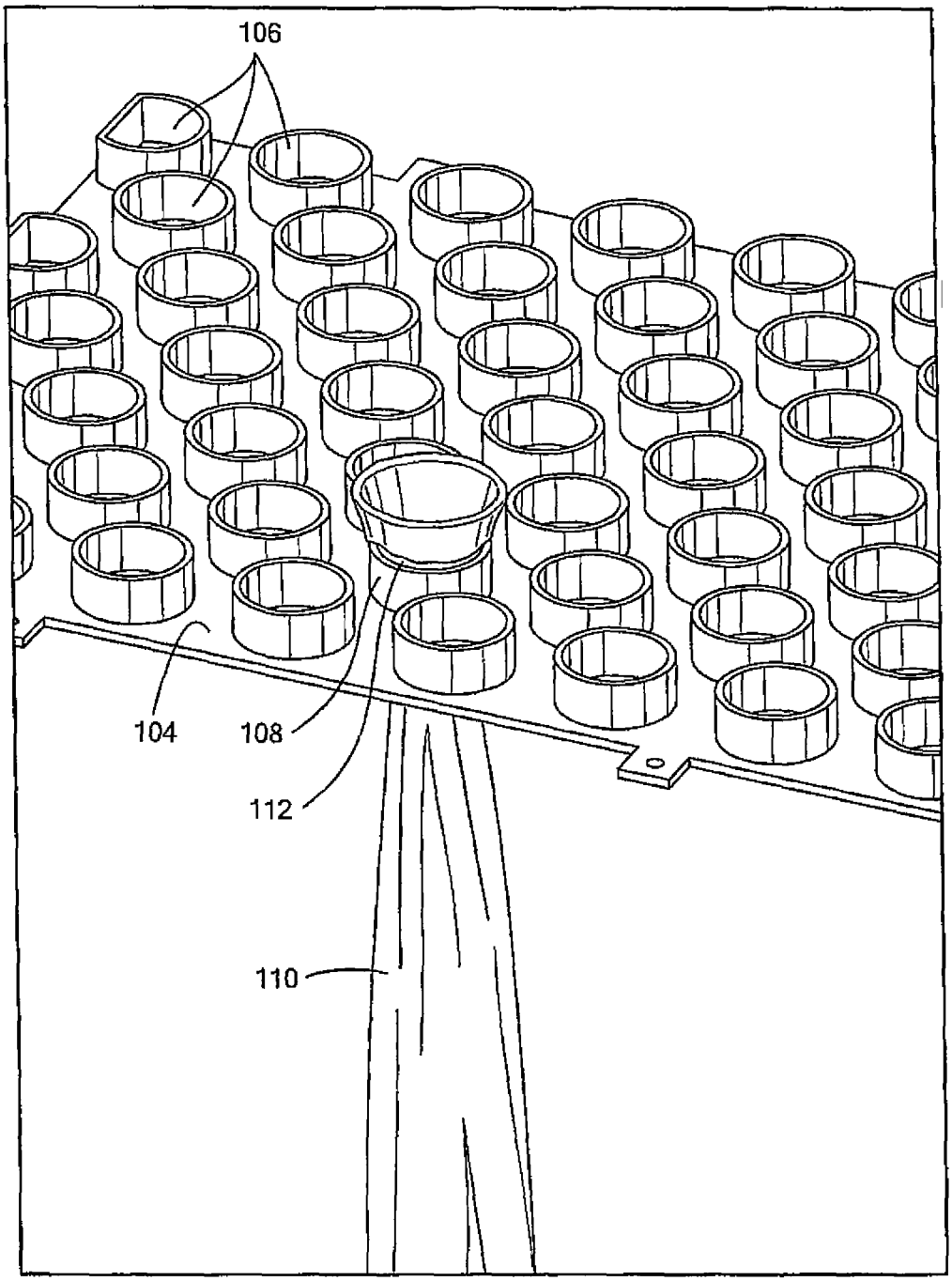
FIG. 18 is a three-dimensional view showing an example of the friction tube holder shown in FIGS. 13-15 secured to a boss of the tube plate shown in FIGS. 5, 6, and 11.

In one design, the tube attachment subsystem includes friction tube holder 112, FIG. 13, configured to secure one of the plurality of barrier tubes 110, FIGS. 5 and 6, to one of orifices 106 by friction. FIG. 14 shows an example of barrier tube 110 disposed through opening 114, FIG. 13 of friction tube holder 112, and extending over lip 116, FIG. 13, of friction tube holder, as indicated at 118, FIG. 14. FIG. 15 shows in further detail barrier tube 110 extending over lip 116 of friction tube holder 112 to secure barrier tube 110 to friction tube holder 112. Friction tube holder 112, FIGS. 13-15 preferably has a cylindrical funnel shape as shown and is configured to mate with one of orifices 106, FIGS. 5-11, in tube plate 104. FIG. 16 shows an example of friction tube holder 112 mating with orifice 106 in tube plate 104. FIG. 17 shows an example of friction tube holder 112 in place in one of orifices 106 of tube plate 104 with barrier tube 110 attached thereto. FIG. 18 shows an example of friction tube holder 112 mated to boss 108, discussed above with reference to FIGS. 10 and 11, with barrier tube 110 attached thereto.

Figure 19:
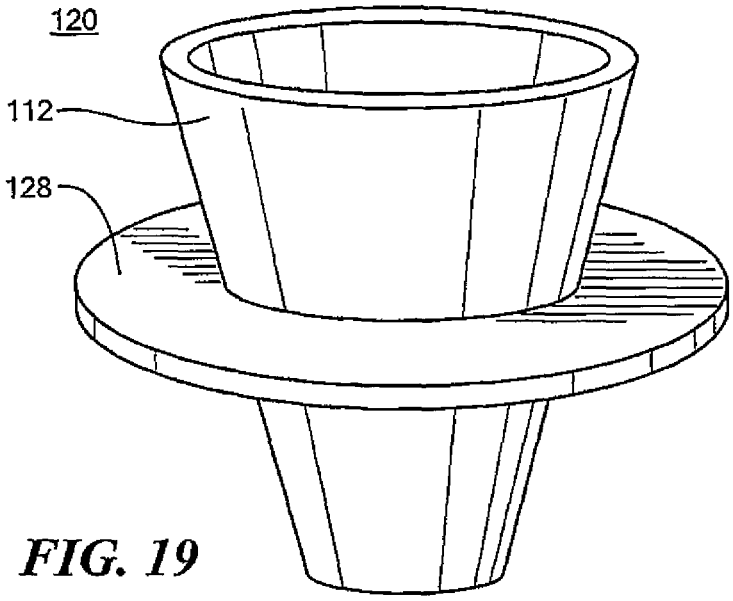
FIG. 19 is a three-dimensional view showing another example of a friction tube holder of the tube attachment subsystem of this invention configured to secure a barrier tube to an orifice of the tube plate shown in one or more of FIGS. 5-12.
Figure 20:
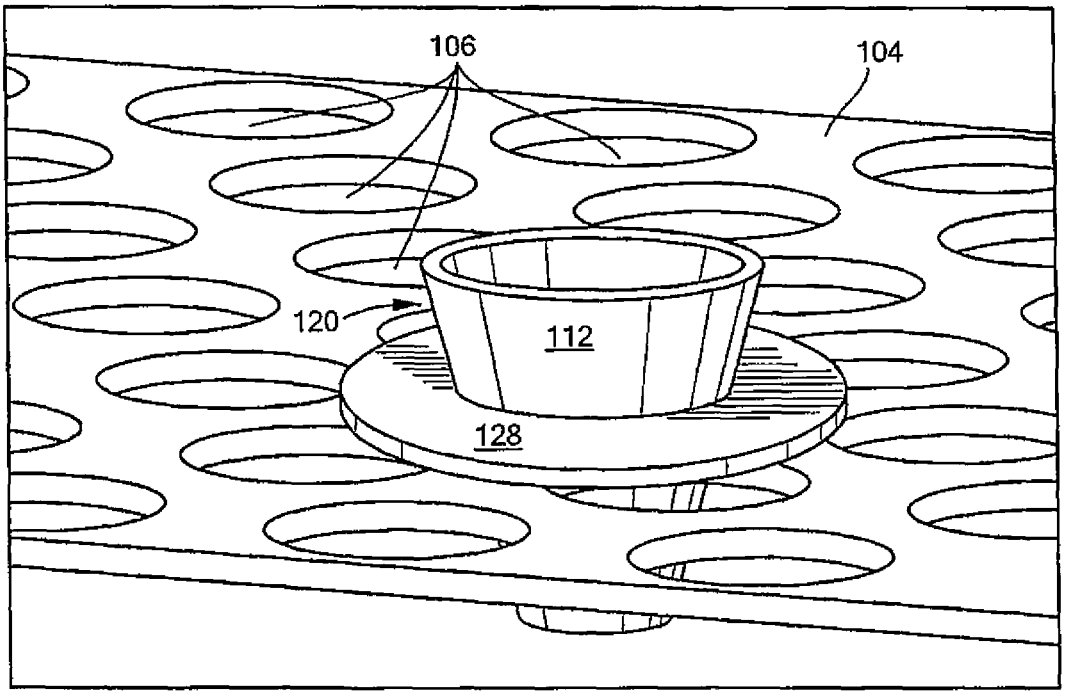
FIG. 20 is a three-dimensional view showing an example of the friction tube holder shown in FIG. 19 secured in place in one of the orifices of the tube plate shown in FIGS. 5, 6, and 9.
Figure 21:
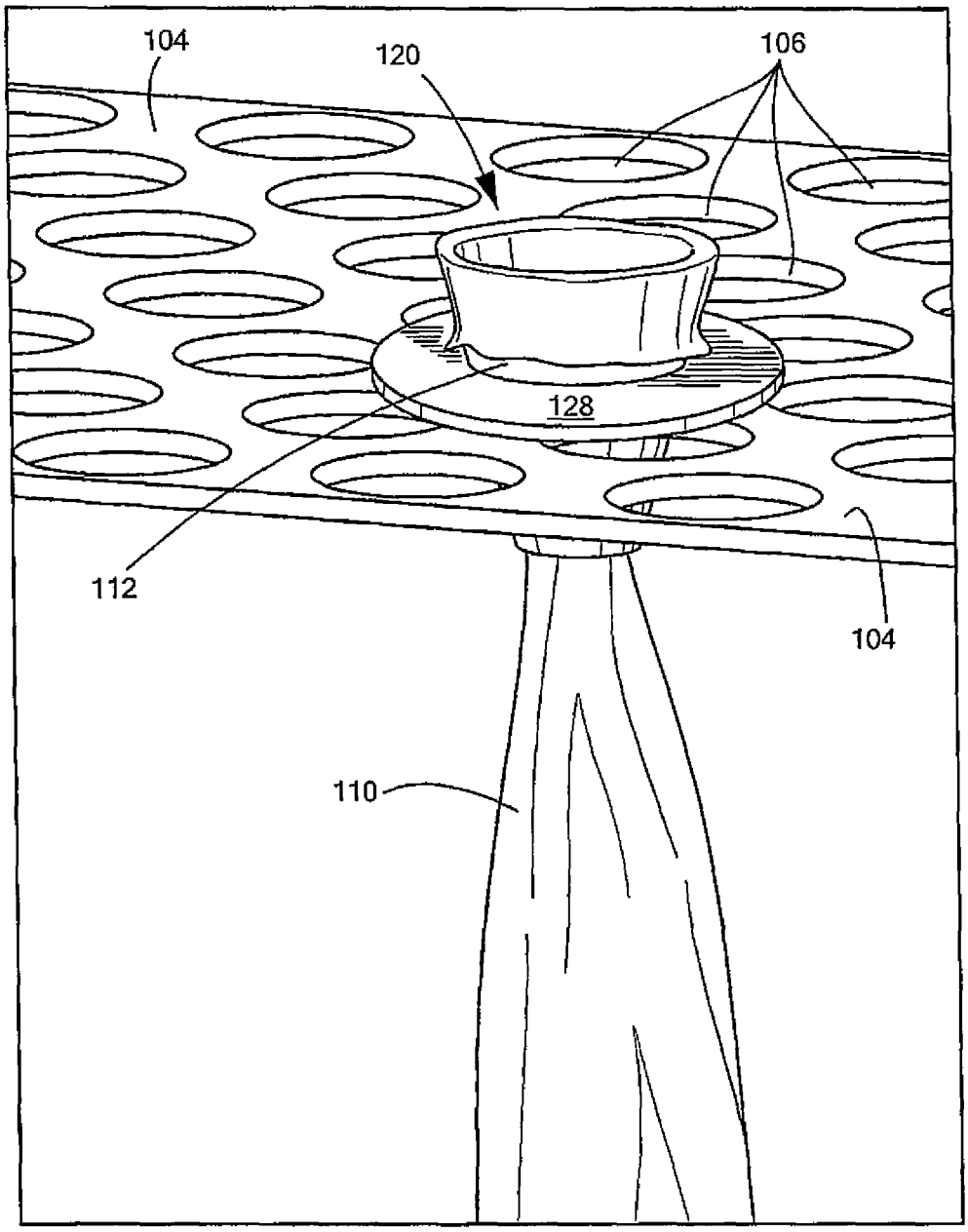
FIG. 21 is a three-dimensional view showing an example of a barrier tube secured to the friction tube holder shown in FIGS. 19-20 secured in place in the tube plate shown in FIGS. 5, 6, and 9.

In another design, the tube attachment subsystem may include friction tube holder 120, FIG. 19, which includes friction tube holder 112 as discussed above, and flange 128 coupled to friction tube holder 112. In this example, friction tube holder 120 preferably mates with each of the plurality of orifices 106 in tube plate 104, e.g., as shown in FIG. 20. FIG. 21 shows an example of friction tube holder 120 mated with an orifice of tube plate 104 with barrier tube 110 coupled secured thereto by friction.

Figure 22:
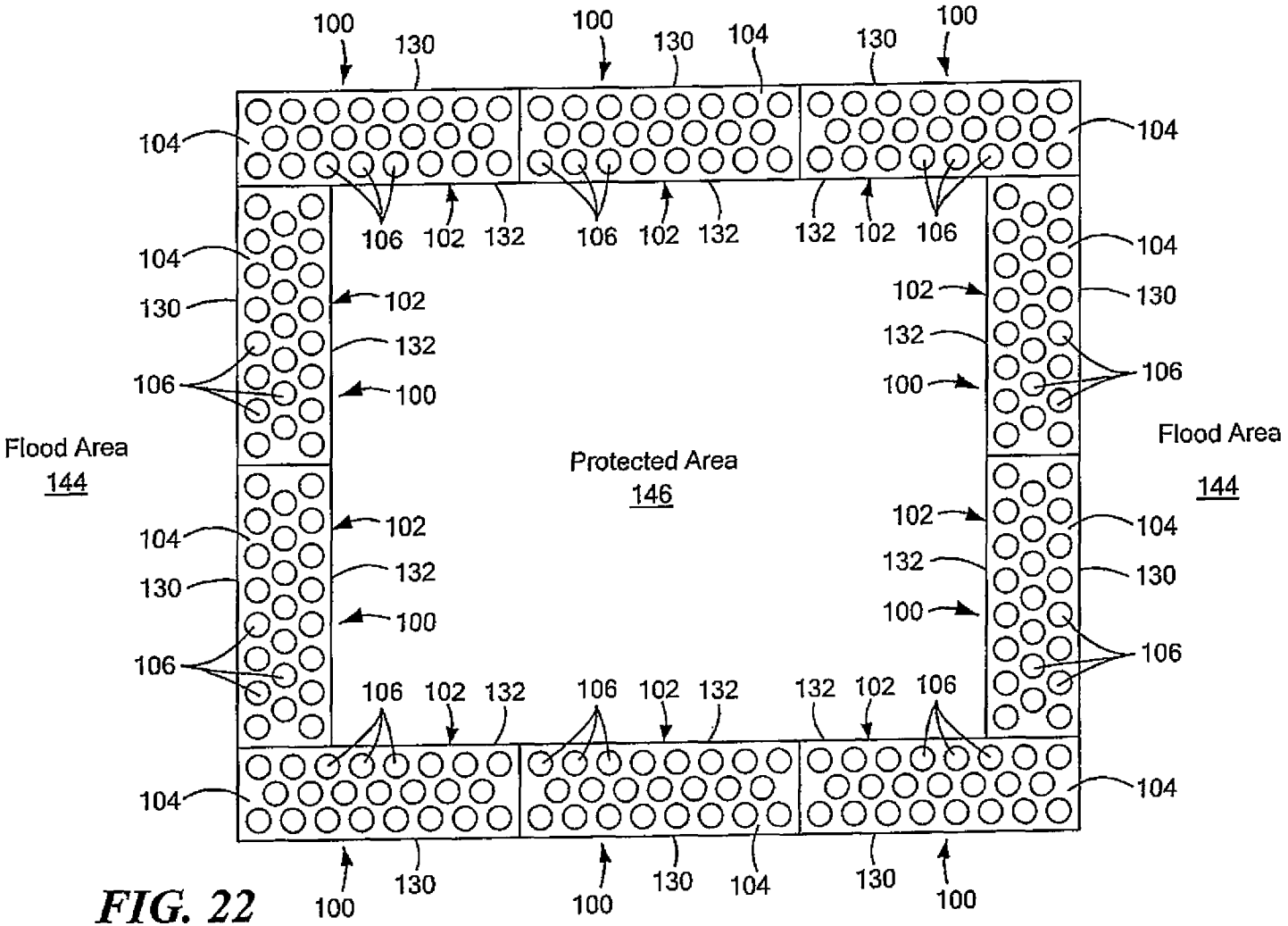
FIG. 22 is a schematic diagram showing one example of a plurality of modules of the system shown in one or more of FIGS. 5-21 used to create a protected area from flood water.

System 100, FIGS. 5 and 6, also includes a plurality of spaced walls 130 and 132, e.g., flood wall 130 and protected area wall 132, configured to support tube plate assembly 102 such that each barrier tube 110 extends vertically downward from tube plate 104 to ground 134 as shown. In one example, spaced walls 130 and 132 may include shelf 136, FIG. 5, on which tube plate 104 is secured thereto, e.g., as shown in FIG. 6. Support of flood wall 130 is placed in front of flood area 144 and support or protected area wall 132 is placed in protected area 146. Support wall 130, 132 do not need to be resistant to water. In one example, support walls 130, 132 may be made of plastic, wood, metal or similar type rigid material. In one example, support walls 130, 132 may have thickness in the range of about ¼ inch to about 1 inch. In one example, each of spaced walls may have height h-172, FIG. 5, of about 4 feet and width w-174 of about 4 feet. In other examples, spaced walls 130, 132 may have any desired height and width as needed to protect protected area 126. Each of spaced walls 130, 132, tube plate assembly 102 and the barrier tubes 110 secured to orifices 106 by the tube attachment subsystem may include interlocking devices (not shown) such that any number of spaced walls 130, 132 with tube plate assembly 102 and the barrier tubes 110 secured to orifices 106 by the tube attachment subsystem can be connected to each other to build a flood barrier of any length or shape, such as a square shape around protected area 146, e.g., as shown in FIG. 22. In other designs, each of spaced walls 130, 132, tube plate assembly 102 and the barrier tubes 110 secured to orifices 106 by the tube attachment subsystem may be arranged in other shapes, e.g., a parallelogram, a trapezoid, a triangle, or arc, and may have rounded corners.

Filling each of barrier tubes 110, FIG. 6, with fluid, such as water, sea water, or any similar type fluid, exemplarily indicated at 138 provides outward hydrostatic pressure proportional to height h-166 of fluid in each barrier tube 110 and the specific gravity of fluid in each barrier tube 110, at each tube-to-tube interface, exemplarily indicated at 140, such that friction loss of a flow of flood water 126 along each barrier tube-to-tube pathway interface 140 stops ingress of flood water 126 from flood area 144 to protected area 146. In this example, each barrier tube 110 is independent of other barrier tubes 110 as shown and is open to the atmosphere as shown. In other embodiments, each barrier tube may be open to a plenum filled with fluid which may be open to the atmosphere or sealed as similar to a hydraulic press, as discussed in further detail below.

Figure 23:
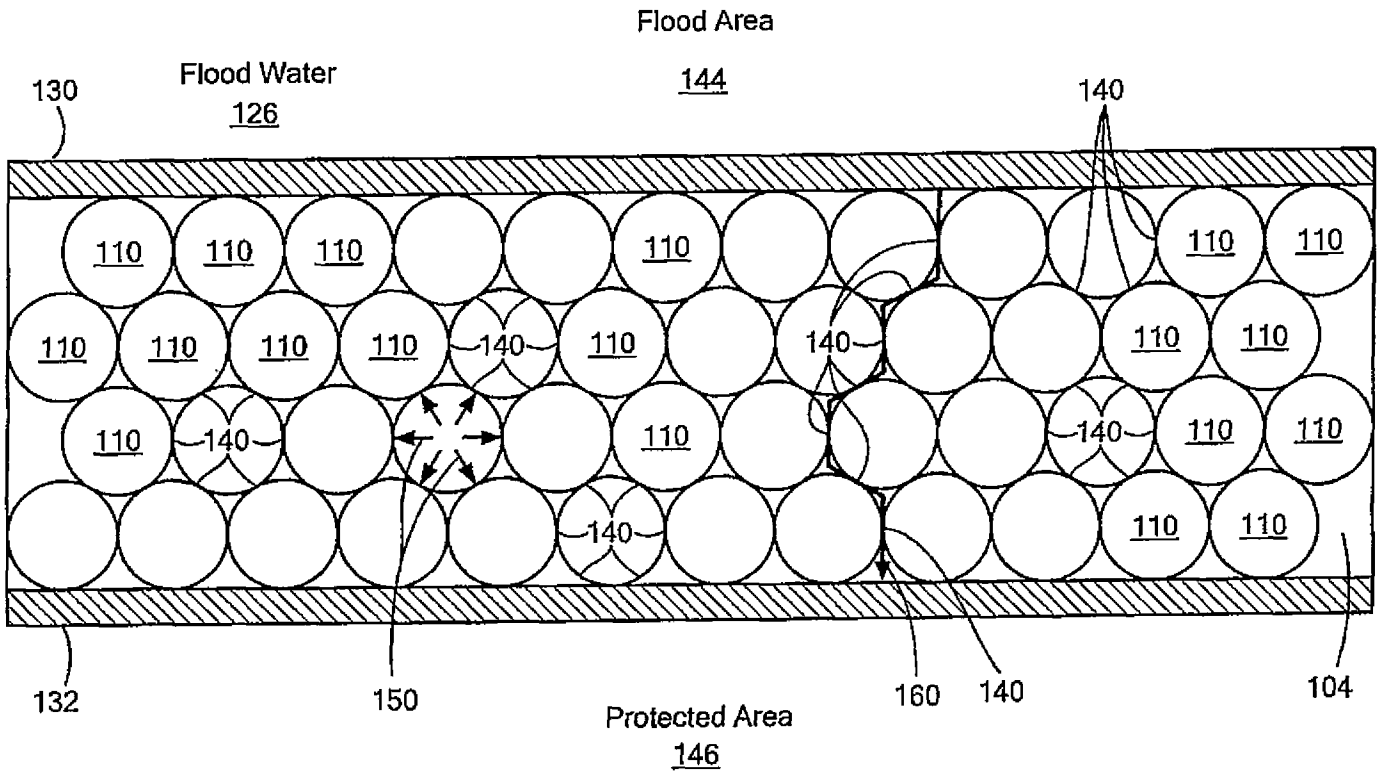
FIG. 23 is a schematic diagram showing in further detail an example of the increased friction loss of a flow of flood water along a barrier tube-to-tube interface pathway of the flood protection system generated by increasing a path length the flood water follows to breach the protected area shown in one or more of FIGS. 5-22 of one embodiment of this invention.

FIG. 23 illustrates an example of each tube-to-tube interface 140 pathway of flood water 126 through the plurality of barrier tubes 110. Filling each barrier tube 110 with fluid having an elevation head at every depth which is greater than the driving head of the flood water provides outward opposing hydrostatic pressure in each of barrier tubes 110 in the direction indicated by arrows 150 at each tube-to-tube interface 140 which is greater than the driving hydrostatic head of the flow of flood water 126 such that friction loss of flood water 126 at every depth along each barrier tube-to-tube interface pathway dissipates the driving pressure of the flood water, eventually stopping the ingress of flood water from flood area 144 to protected area 146. In this example, interface pathway 160 depicts a flow of flood water 126 along various barrier tube-to-tube interfaces 140 and shows that the opposing hydrostatic pressure at each tube-to-tube interface 140 pathway increases the friction loss along pathway 160 of the flood water to dissipate the driving force of flood water 126 at every height, h-124, FIG. 6, of flood water 126. As known by those skilled in the art, increasing the path length of the flow of flood water 126 is analogous to a longer pipe, and increasing the number of turns is analogous to adding more "elbows" or "valves" in a pipe, both of which increase friction losses, reducing the driving pressure of the flow of flood water 126 and stopping the ingress of flood water 126 from flood area 144 to protected area 146. Thus, opposing the flood water 126 at every depth by the greater elevation head in each barrier tube 110 further amplifies these friction losses.

In one embodiment, the predetermined pattern and density of orifices 106 with barrier tubes 110 secured thereto by the tube attachment subsystem is preferably configured to increase barrier tube-to-tube interface 140 pathway to further increase friction loss to stop the ingress of flood water from flood area 144, FIGS. 6 and 23, to protected area 146.

The predetermined pattern and density of orifices 106 with barrier tubes 110 secured thereto are preferably configured to increase the friction loss of the flow of flood water 126 along each barrier tube-to-tube interface pathway by creating hydrostatic pressure at each tube-to-tube interface as discussed above.

Figure 24:
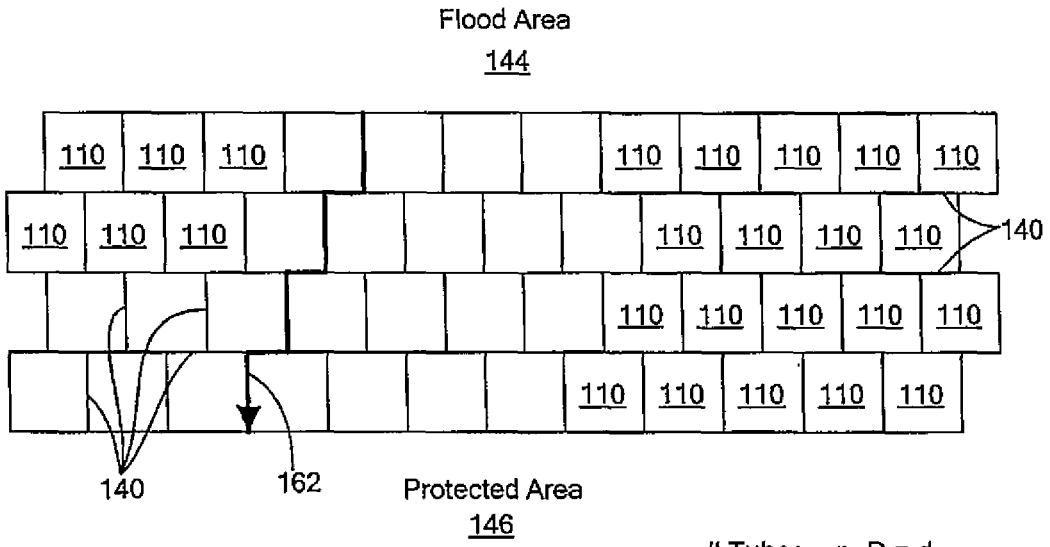
FIGS. 24 and 25 are schematic diagrams showing in further detail examples of increasing the path length of a flow of flood water along a barrier tube-to-tube interface pathway to increase friction loss by increasing the density of the barrier tubes of the flood protection system shown in one or more of FIGS. 2-23.
Figure 25:
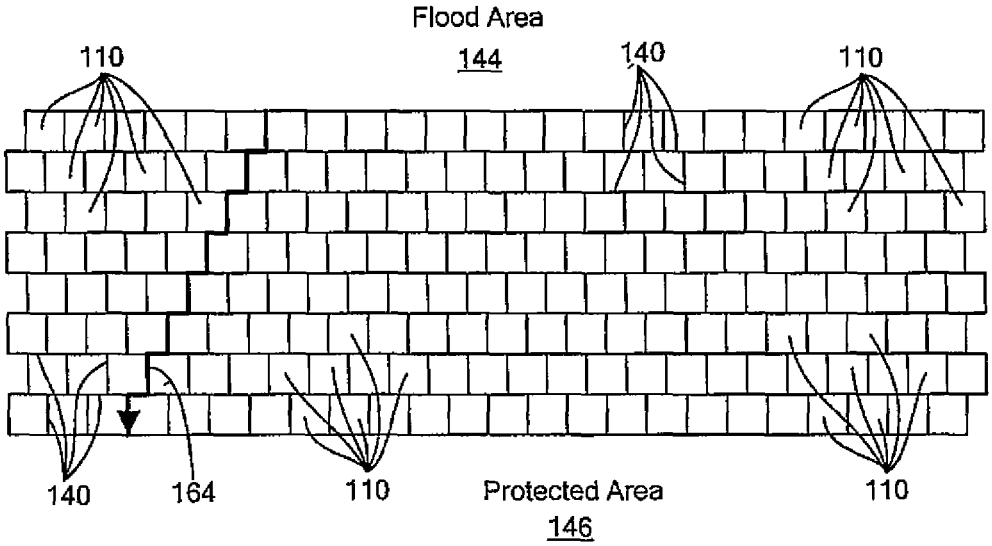

For example, FIG. 24 shows an example of interface pathway 162 for a plurality of barrier tubes 110, in this example shown as square shaped barrier tubes arranged in the predetermined pattern and density as shown to increases tube-to-tube interface 140 to a path length of 5½ units with six turns. FIG. 25, where, in this example barrier tubes 110 are approximately half the size of barrier tubes 106, FIG. 24, similarly shows an example of interface pathway 164 which increases the path length to 5¾ units and includes fourteen turns as shown. The combination of the increased path length and increased number of turns increase the friction loss to stop the ingress of flood water 126 FIGS. 6 and 23, to protected area 146.

Figure 26:
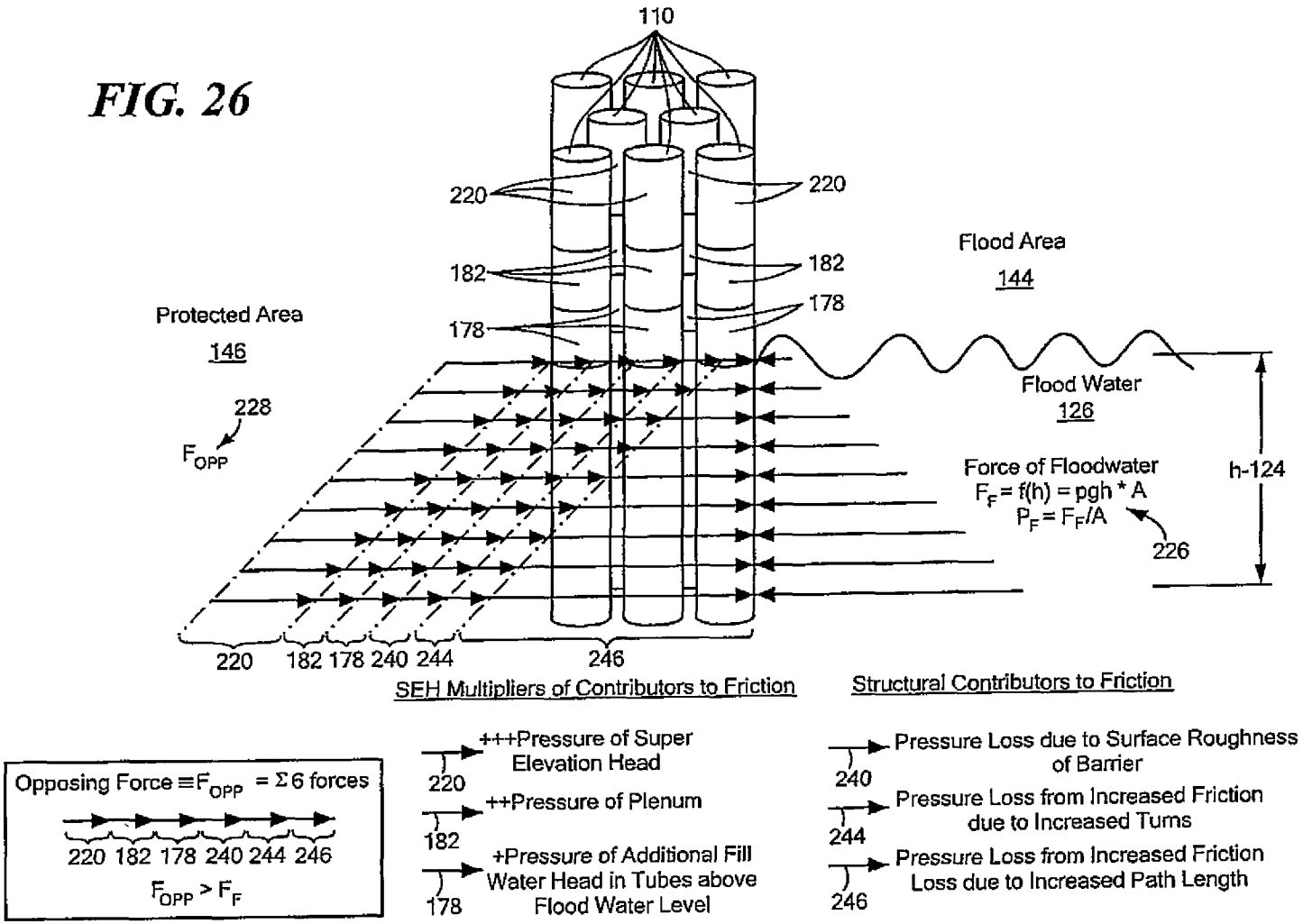
FIG. 26 is a three-dimensional view showing an example of opposing hydrostatic force in the barrier tubes may be increased by an extended elevation head created by the barrier tubes shown in FIG. 6 extending higher than the level of the flood water and also showing examples of super elevation head.

In one embodiment, each of barrier tubes 110, FIGS. 5 and 6, are preferably configured to extend higher than the level of flood water at a height of h-176, FIG. 6, to create an extended elevation tube on each of barrier tubes 110 filled with fluid to increase outward hydrostatic pressure at each tube-to-tube interface 140 thereby increasing friction loss at each barrier tube-to-tube interface 140 pathway to stop the ingress of flood water 126 from flood area 144 to protected area 146. FIG. 26 depicts an example of an extended elevation head indicated at 178 provided by the fluid in each of barrier tubes 110 extending height h-176, FIG. 6, above height h-124 of flood water 126.

Figure 27:
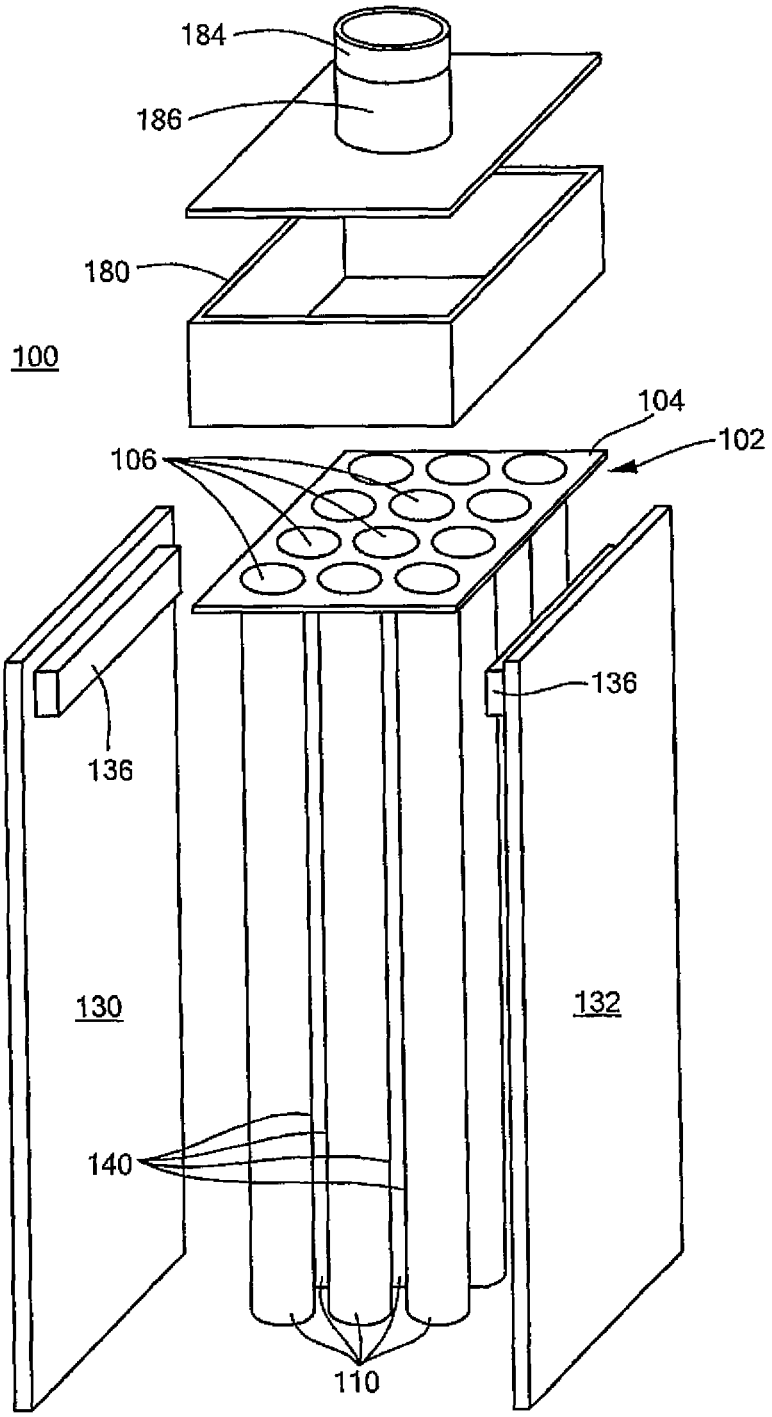
FIGS. 27 and 28 are three-dimensional views of another embodiment of the flood protection system of this invention including a plenum above and sealed to the tube plate assembly and barrier tubes shown in FIGS. 5 and 6 to create a super elevation head on each barrier tube to further increase the hydrostatic pressure in the barrier tubes at every level.
Figure 28:
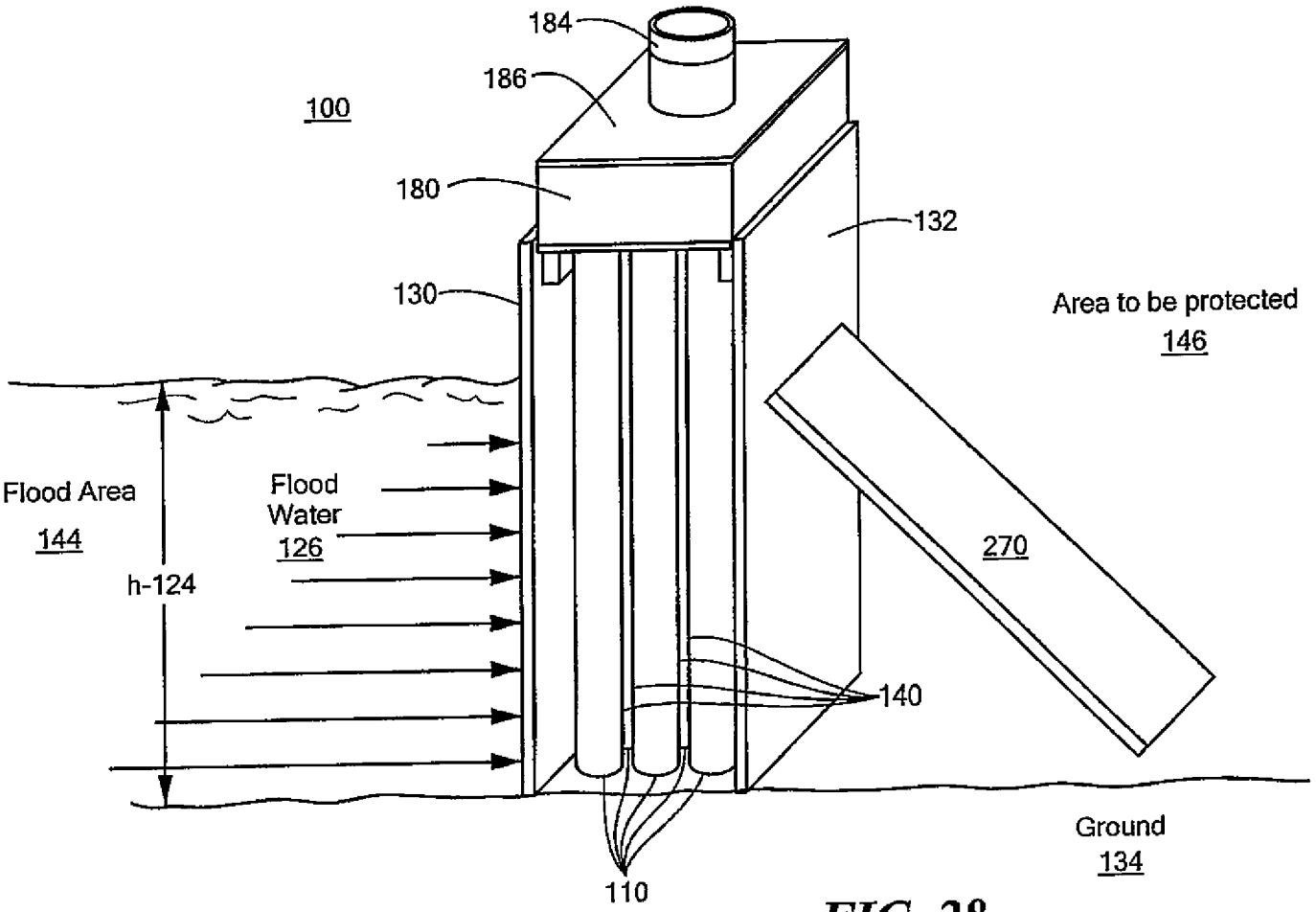
Figure 29:
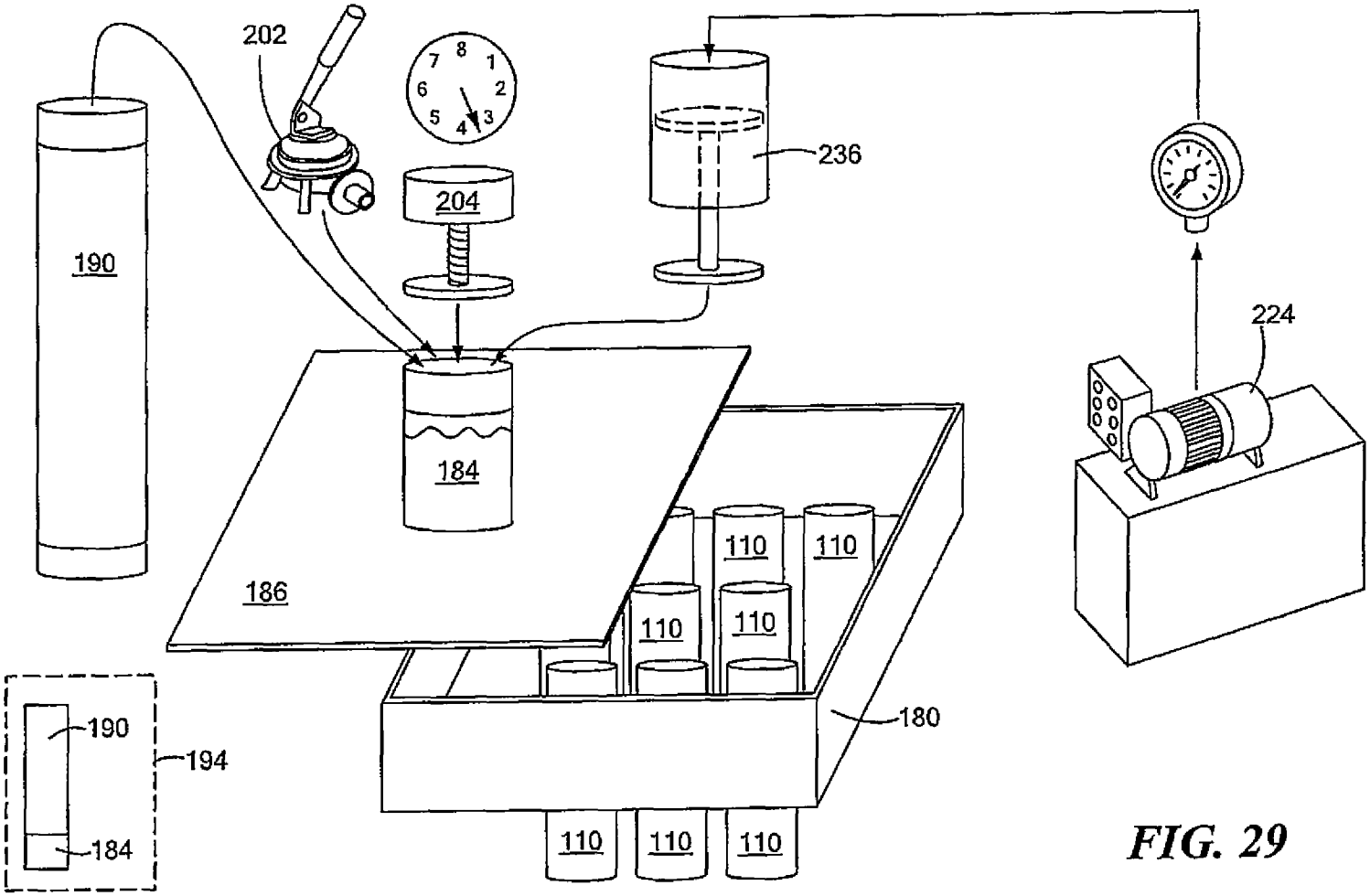
FIG. 29 is a three-dimensional view showing examples of various devices which may be used to create a super elevation head for the system shown in FIGS. 27 and 28.

In one design, flood protection system 100, FIGS. 5 and 6 may include plenum 180, FIGS. 27, 28 and 29 preferably including plenum cover 186 sealed to plenum 180, as shown in FIG. 28. Plenum 180 is coupled above and preferably to tube plate assembly 102 and configured to store a predetermined amount of an incompressible fluid therein. For exemplary purposes only, FIGS. 27 and 29 show plenum cover 186 of plenum 180 not attached and FIG. 28 shows plenum 180 with its plenum cover 186 sealed thereto. Plenum 180 creates a super elevation head on each of barrier tube 110 filled with a fluid to increase outward hydrostatic pressure and increase friction loss at each barrier tube-to-tube interface 140 pathway, FIG. 28, e.g., as discussed above. FIG. 26 shows an example of a super elevation head created by the fill fluid in plenum 180, indicated at 182 which increases the outward hydrostatic pressure in each of barrier tubes 110 and increases friction loss at each tube-to-tube interface 140 pathway. In one design, plenum 180, FIGS. 27-29 preferably includes super elevation head connector 184 coupled to plenum 180 as shown. As discussed, plenum 180 preferably, includes plenum cover 186 sealed to plenum 180. However, super elevation connector 184 may be open to the atmosphere or sealed, depending on how the super elevation head is achieved. In one design, plenum 180 may not include sealed plenum cover 186 and may be filled with a fluid to create a super elevation head.

In one design, to create the super elevation head, flood protection system 100 preferably includes a super elevation head extender 190, FIG. 29, e.g., a cylindrically shaped tube as shown, configured to store a predetermined amount of water therein and is attached to super elevation head connector 184 in the upright position as indicated at 192 in caption 194. In the example shown in FIG. 29, plenum 180 is shown with plenum cover 188 not sealed in place. However, in operation, plenum cover 186 will be sealed to plenum 180, e.g., as shown in FIG. 28, which is also sealed to tube plate assembly 102 having a plurality of orifices each having a barrier tube 110 attached thereto as discussed above.

In another design, flood protection system 100, FIGS. 27-29, may include a compression super elevation head subsystem 196, FIG. 29, coupled to super elevation connector 184 to increase the hydrostatic pressure in the fluid in plenum 180 to create the super elevation head. In one example, the compression super elevation head subsystem 196 may include a mechanical fluid pump, such as mechanical fluid pump 202 or a screw-type piston and rod assembly 204 which are coupled to super elevation head connector 184 and are used to mechanically increase the hydrostatic pressure on the fluid in the plenum 180 to create the super elevation head. In this design, mechanical fluid pump 202 or screw-type piston and rod assembly 204 needs to be sealed to super elevation head connector 184, thereby sealing it to plenum 180. In other designs, the compression super elevation subsystem may include a hydraulic or pneumatic pump 224 configured to drive a piston 236 against fluid in super elevation head connector 184 (hydraulic) or gas directly into the super elevation head connector 184 to create the super elevation head. FIG. 26 shows an example of a super elevation head applied to each barrier tube 110 indicated at 220. Similar to mechanical fluid pump 202 or screw-type piston and rod assembly 204 system, the hydraulic or pneumatic pump needs to be sealed to super elevation head connector 184 which is sealed to plenum 180 which is sealed to tube plate assembly 102 having a plurality of orifices each having a barrier tube 110 attached thereto as discussed above. In the example shown in FIG. 26, the forces associated with flood water 126 are indicated at 226 and the opposing forces provided by flood protection system 100 are indicated at 228. To those skilled in the art, this is the concept of the hydraulic press.

In one design, each of barrier tubes 110 shown in one or more of FIGS. 5-26 may have a rough surface 230, FIG. 12, indicated at 232 in caption 234. The surface roughness on each of barrier tubes 110 may increase friction loss along the flow path of a flow of flood water 126 along each barrier tube-to-tube interface 140 pathway. An example of this type of friction loss is indicated at 240, FIG. 26. The pressure loss due to increased friction associated with increasing the path length of a flow of flood water by increasing the number of turns, as discussed above with reference to FIGS. 24 and 25, is indicated at 244 and the pressure loss and increasing friction associated with increases in the path length is indicated at 246.

In one example, each barrier tube 110, FIGS. 5, 6, and 28 may be filled with a fluid having a greater specific gravity than the specific gravity of flood water 126, e.g., sea water or similar type fluid. Filling barrier tubes 110 with a fluid having a greater specific gravity than flood water 126, e.g., further increases the friction loss, discussed above.

Figure 30:
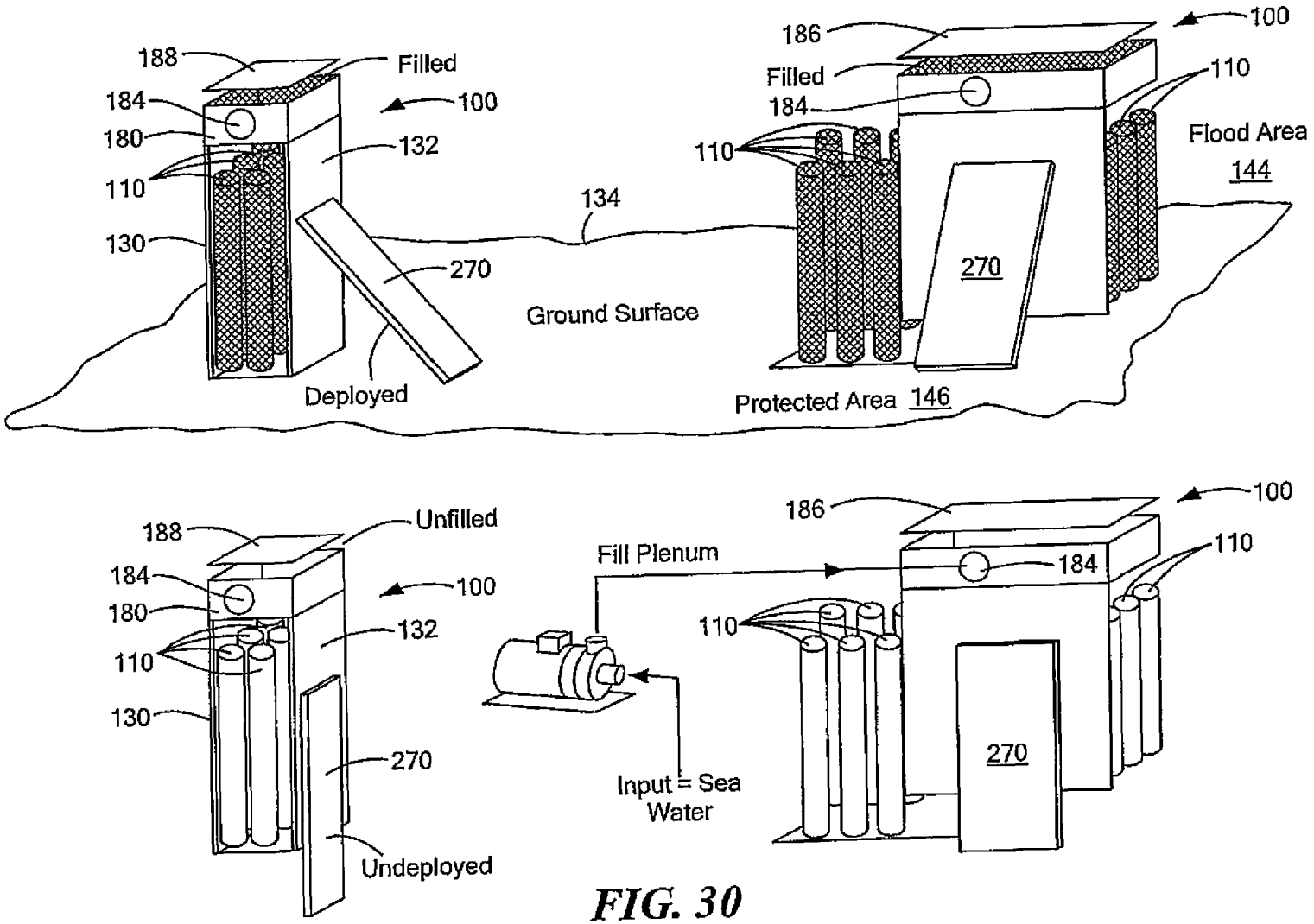
FIG. 30 is a three-dimensional view showing an example of the flood protection system shown in one of more of FIGS. 5-29 which may be stored under ground surface then deployed in the event of a flood or storm surge.

In one design, flood protection system 100 as discussed above with reference to one or more of FIGS. 5-29 with tube plate assembly 102, tube plate 104, the tube attachment subsystem, barrier tubes 110, space walls 130 and 132, and optional plenum 180, may be positioned below ground and deployed in the event of a flood event, e.g., configured as a sea wall, or similar type flood wall as shown in FIG. 30. In the example shown in FIG. 30, tube plate assembly 102 is inside plenum 180 and cannot be seen. For exemplarly purposes only, barrier tubes 110 are not shown attached to the tube plate assembly. In operation, barriers tubes 110 are secured to tube plate assembly and flood protection system 100 is configured and operates a discussed above with reference to one or more of FIGS. 5-28.

In one design, flood protection system 100, FIGS. 5, 6, 27 and 28 may include brace 270, FIGS. 6 and 28, coupled to spaced wall, e.g., protected area wall 132, to provide additional support to flood protection system 100.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

What is claimed is:

1. A flood protection system comprising:

a plurality of open ended, independent, conformable, and impermeable barrier tubes;

a tube plate assembly including:

a tube plate including a plurality of orifices arranged in a predetermined pattern and density, and a tube attachment subsystem associated with each of the plurality of orifices configured to secure the plurality of open ended, independent, conformable, and impermeable barrier tube thereto;

a plurality of spaced walls configured to support the tube plate assembly above the ground such that each barrier tube extends vertically downward from the tube plate to the ground; and wherein filling each said barrier tube with the fluid provides outward hydrostatic pressure at each tube-to-tube interface such that friction loss of a flow of flood water along each tube-to-tube interface pathway stops the ingress of the flood water from a flood area to a protected area.

2. The system of claim 1 in which the predetermined pattern and said density of said plurality of orifices each having a barrier tube attached thereto are configured to increase the tube-to-tube interface pathway to increase the friction loss to stop the ingress of the flood water from the flood area to the protected area.

3. The system of claim 1 in which the predetermined pattern and density of said plurality of orifices each having a barrier tube attached thereto increases a path length and number of turns of the tube-to-tube interface pathway to increase the friction loss of the flow of flood water along each barrier tube-to-tube interface pathway to stop the ingress of the flood water from the flood area to the protected area.

4. The system of claim 1 in which the predetermined pattern includes a plurality of orifices arranged in an offset pattern of rows.

5. The system of claim 1 in which the predetermined pattern includes a plurality of orifices aligned in rows.

6. The system of claim 2 in which the density of the orifices includes a high density of orifices.

7. The system of claim 1 in which the density of orifices includes a low density of orifices.

8. The system of claim 2 in which the tube plate includes a boss secured to each orifice.

9. The system of claim 1 in which the tube attachment subsystem includes a friction tube holder associated with each orifice and configured to secure a barrier tube to the orifice thereto by friction.

10. The system of claim 9 in which the friction tube holder has a cylindrical funnel shape configured to mate with an orifice of the tube plate.

11. The system of claim 10 in which the friction tube holder is configured to mate with a boss coupled to an orifice.

12. The system of claim 9 in which the friction tube holder includes a flange attached thereto.

13. The system of claim 12 in which the flange is configured to mate with an orifice of the tube plate.

14. The system of claim 1 in which each said barrier tube is configured to extend higher than a level of the flood water to create an extended elevation head on each said barrier tube filled with a fluid to increase the outward hydrostatic pressure at each tube-to-tube interface to increase friction loss at each barrier tube-to-tube interface pathway.

15. The system of claim 1 further including a plenum coupled above and to the tube plate assembly configured to store fluid therein to create a super elevation head on each said barrier tube filled with a fluid to increase the outward hydrostatic pressure and increase friction loss at each barrier tube-to-tube interface pathway.

16. The system of claim 15 in which the plenum includes a plenum lid sealed to the plenum.

17. The system of claim 15 further including a super elevation head connector coupled to the plenum.

18. The system of claim 17 further including a super elevation head extender coupled to the super elevation head connector configured to store fluid therein, said fluid configured to further increase said super elevation head.

19. The system of claim 17 further including a compression super elevation head subsystem coupled to the super elevation head connector configured to increase hydrostatic pressure in the plenum to create the super elevation head.

20. The system of claim 19 in which the compression super elevation head subsystem includes a mechanical pump.

21. The system of claim 19 in which the compression super elevation head subsystem includes a hydraulic or pneumatic pump configured to drive a fluid or gas against a piston in a fluid-filled super elevation head connector to create the super elevation head.

22. The system of claim 1 further including a brace coupled to one of the spaced walls configured to provide support to the tube plate assembly in the spaced walls.

23. The system of claim 1 in which said tube plate assembly, including said tube plate and said tube attachment subsystem and said barrier tubes and said plurality of spaced walls are positioned below a ground level and deployed in the event of a flood.

24. The system of claim 23 in which each barrier tube is filled with a fluid having a specific gravity greater than the specific gravity of the flood water to further increase the hydrostatic pressure and increase friction loss.

25. A flood protection system comprising:

a plurality of open ended, independent, conformable, and impermeable barrier tubes;

a tube plate assembly including:

a tube plate including a plurality of orifices arranged in a predetermined pattern and density, and a tube attachment subsystem associated with each of the plurality of orifices configured to secure the plurality of open ended, independent, conformable, and impermeable barrier tube thereto;

a plurality of spaced walls configured to support the tube plate assembly above the ground such that each barrier tube extends vertically downward from the tube plate to the ground;

wherein filling each said barrier tube with the fluid provides outward hydrostatic pressure at each tube-to-tube interface such that friction loss of a flow of flood water along each tube-to-tube interface pathway stops the ingress of the flood water from a flood area to a protected area; and a plenum coupled above and to the tube plate assembly configured to store fluid therein to create a super elevation head on each barrier tube filled with the fluid to increase outward hydrostatic pressure and increase friction loss at each barrier tube-to-tube interface.

26. A flood protection system comprising:

a plurality of open ended, independent, conformable, and impermeable barrier tubes;

a tube plate assembly including:

a tube plate including a plurality of orifices arranged in a predetermined pattern and density, and a tube attachment subsystem associated with each of the plurality of orifices configured to secure the plurality of open ended, independent, conformable, and impermeable barrier tube thereto;

a plurality of spaced walls configured to support the tube plate assembly above the ground such that each barrier tube extends vertically downward from the tube plate to the ground;

wherein filling each said barrier tube with the fluid provides outward hydrostatic pressure at each tube-to-tube interface such that friction loss of a flow of flood water along each tube-to-tube interface pathway stops the ingress of the flood water from a flood area to a protected area; and each said barrier tube is configured to extend higher than a level of the flood water to create an extended elevation head on each said barrier tube filled with the fluid to increase the outward hydrostatic pressure at each tube-to-tube interface to increase friction loss at each barrier tube-to-tube interface pathway.

* * * * *